US011649553B2

(12) United States Patent
Inagaki et al.

(10) Patent No.: US 11,649,553 B2
(45) **Date of Patent: *May 16, 2023**

(54) ELECTROLYTIC SOLUTION GENERATOR

(71) Applicant: PANASONIC INTELLECTUAL PROPERTY MANAGEMENT CO., LTD., Osaka (JP)

(72) Inventors: Kenichiro Inagaki, Shiga (JP); Tomohiro Yamaguchi, Shiga (JP); Osamu Imahori, Shiga (JP); Shunsuke Mori, Osaka (JP); Minoru Nagata, Kyoto (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 17/689,427

(22) Filed: Mar. 8, 2022

(65) Prior Publication Data

US 2022/0195614 A1 Jun. 23, 2022

Related U.S. Application Data

(62) Division of application No. 16/509,386, filed on Jul. 11, 2019, now Pat. No. 11,299,812.

(30) Foreign Application Priority Data

Jul. 13, 2018 (JP) ..... JP2018-133658
Jul. 13, 2018 (JP) ..... JP2018-133659

(51) Int. Cl.
*C25B 15/00* (2006.01)
*C25B 15/08* (2006.01)
(Continued)

(52) U.S. Cl.
CPC ..... *C25B 15/08* (2013.01); *C25B 1/13* (2013.01); *C25B 9/23* (2021.01)

(58) Field of Classification Search
CPC ..... C25B 15/08
See application file for complete search history.

(56) References Cited

U.S. PATENT DOCUMENTS

2019/0055144 A1 2/2019 Inagaki et al.

FOREIGN PATENT DOCUMENTS

JP 2017-176993 A 10/2017
WO 2017/168475 10/2017

OTHER PUBLICATIONS

Non-Final Office Action dated Jun. 30, 2021 issued in U.S. Appl. No. 16/509,386.

(Continued)

*Primary Examiner* — Zulmariam Mendez
(74) *Attorney, Agent, or Firm* — McDermott Will & Emery LLP

(57) ABSTRACT

An electrolytic solution generator includes an electrolyzing unit having a stacked structure in which a conductive film is interpose between a cathode and an anode, the electrolyzing unit electrolyzing a liquid, and a housing in which the electrolyzing unit is placed. A channel is disposed in the housing, and a groove is disposed in the electrolyzing unit, as a groove which is open to the channel and to which at least a part of an interface between the conductive film and the cathode and an interface between the conductive film and the anode is exposed. A space is disposed between at least either an outer periphery of the cathode or an outer periphery of the anode and an inner surface of the housing.

6 Claims, 16 Drawing Sheets

(51) Int. Cl.
*C25B 1/13* (2006.01)
*C25B 9/23* (2021.01)

(56) References Cited

OTHER PUBLICATIONS

Notice of Allowance dated Jan. 20, 2022 issued in U.S. Appl. No. 16/509,386.
Indian Examination Report dated Apr. 7, 2022 for the related Indian Patent Application No. 202147000206.

ELECTROLYTIC SOLUTION GENERATOR

RELATED APPLICATIONS

This application is a Divisional of U.S. patent application Ser. No. 16/509,386, filed on Jul. 11, 2019, which claims the benefit of foreign priority of Japanese Patent Application No. 2018-133658, filed on Jul. 13, 2018, and Japanese Patent Application No. 2018-133659, filed on Jul. 13, 2018, the contents of which are incorporated herein by reference.

BACKGROUND

1. Technical Field

The present disclosure relates to an electrolytic solution generator.

2. Description of the Related Art

A conventional electrolytic solution generator is known, which includes an electrolyzing unit composed of a stack of an anode, a conductive film, and a cathode and in which the electrolyzing unit generates ozone (electrogenerated product) to obtain ozonized water (electrolytic solution) (see, for example, PTL 1).

The electrolyzing unit described in PTL 1 has grooves where holes formed on the cathode serving as an electrode communicate with holes formed on the conductive film. By applying a voltage to the electrolyzing unit, water lead into the grooves is electrolyzed to produce ozone.

CITATION LIST

Patent Literature

PTL 1: Unexamined Japanese Patent Publication No. 2017-176993

SUMMARY

According to the above conventional technique, the electrolyzing unit is placed in a housing such that an outer periphery of the electrolyzing unit is in contact with an inner surface of the housing.

However, even if the outer periphery of the electrolyzing unit is brought into contact with the inner surface of the housing, a positional shift that occurs during stacking work creates a minute gap between the outer periphery of the electrolyzing unit and the inner surface of the housing. This raises a concern that water may enter the minute gap created along the periphery of the electrolyzing unit to stay in the gap.

If water is electrolyzed to produce ozone as water stays along the periphery of the electrolyzing unit, a pH value of water staying along the periphery of the electrolyzing unit rises. In such a case, scales mainly made of a calcium component tend to develop, raising a concern that the scales may pile up in the minute gap.

When scales produced by electrolyzation of water pile up in the minute gap formed along the periphery of the electrolyzing unit, the housing and the electrolyzing unit are pressurized by the scales piling up in the minute gap, which may lead to deformation of the housing and the electrolyzing unit.

An object of the present disclosure is to provide an electrolytic solution generator that can inhibit pressure application by scales to a housing and an electrolyzing unit.

An electrolytic solution generator according to the present disclosure includes an electrolyzing unit having a stacked structure in which a conductive film is interpose between a cathode and an anode, the electrolyzing unit electrolyzing a liquid, and a housing in which the electrolyzing unit is placed.

In the housing, a channel is disposed, the channel having an inlet into which a liquid to be supplied to the electrolyzing unit flows and an outlet from which an electrolytic solution generated by the electrolyzing unit flows out and causing a liquid to flow in a liquid-flow direction intersecting a stacking direction of the stacked structure.

In the electrolyzing unit, a groove is disposed as a groove which is open to the channel and to which at least a part of an interface between the conductive film and the cathode and an interface between the conductive film and the anode is exposed.

A space is disposed between at least either an outer periphery of the cathode or an outer periphery of the anode and an inner surface of the housing.

According to the present disclosure, the electrolytic solution generator that can inhibit pressure application by scales to the housing and the electrolyzing unit can be obtained.

DETAILED DESCRIPTION

Exemplary embodiments of the present disclosure will hereinafter be described with reference to drawings. It should be noted that the following exemplary embodiments do not limit the present disclosure.

In the following description, an ozonized water generator that generates ozone (electrogenerated product), causes ozone to dissolve into water (liquid), thereby generates ozonized water (electrolyzed water, i.e., electrolytic solution), will be explained exemplarily as an electrolytic solution generator.

Ozonized water, which is effective for sterilization and organic material decomposition, is widely used in fields of water processing, food, and medical practice. Ozonized water has advantages of causing no residual effect and creating no byproduct.

In the following description, a direction in which a channel extends is defined as liquid-flow direction X (in which a liquid flows), a widthwise direction of the channel as a width direction Y (which intersects the liquid-flow direction), and a direction in which electrodes and a conductive film are stacked as stacking direction Z (see FIG. 1).

In the following exemplary embodiments, a vertical direction of the electrolytic solution generator that is disposed with its electrode case lid located on the upper side represents stacking direction Z.

First Exemplary Embodiment

Figure 1:
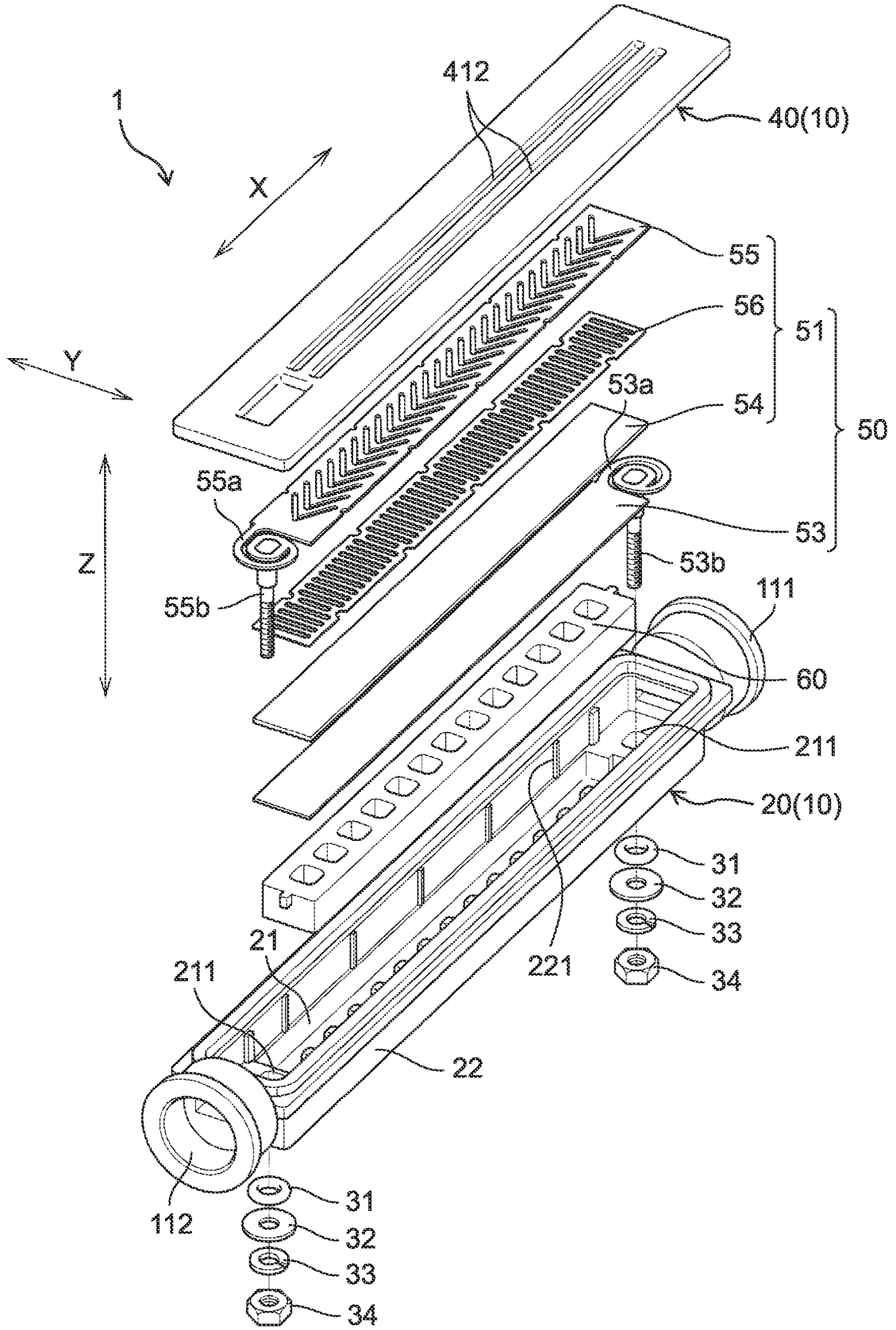
FIG. 1 is an exploded perspective view of an electrolyzed water generator according to one exemplary embodiment of the present disclosure.
Figure 2:
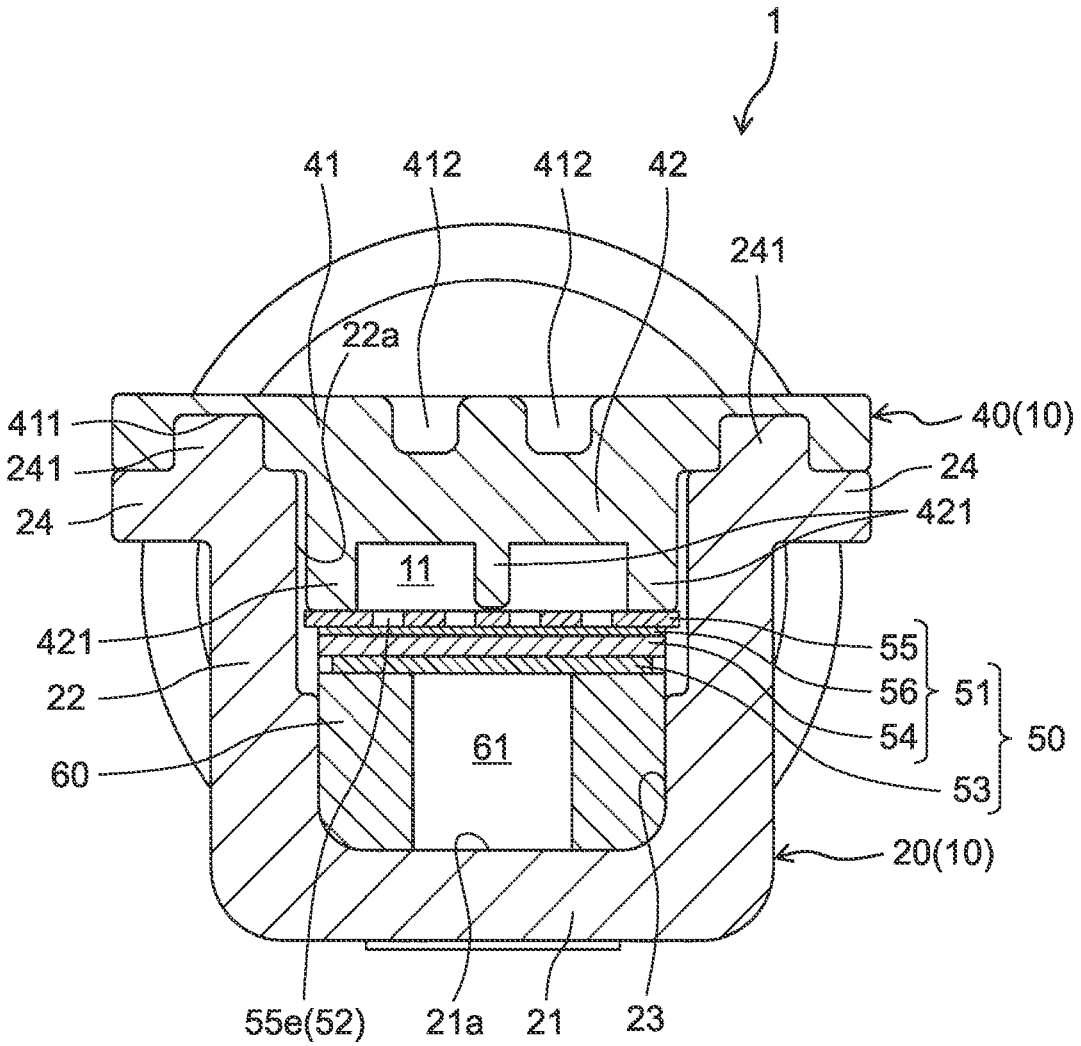
FIG. 2 is a sectional view taken by cutting the electrolyzed water generator according to the one exemplary embodiment of the present disclosure along a plane perpendicular to a liquid-flow direction.

As shown in FIGS. 1 and 2, ozonized water generator 1 according to an exemplary embodiment includes housing 10, in which channel 11 is formed (see FIG. 2).

Inside housing 10, where channel 11 is formed, electrolyzing unit 50 is disposed in such a way as to face channel 11. Water flowing through channel 11 is electrolyzed by electrolyzing unit 50. According to the present exemplary embodiment, electrolyzing unit 50 is disposed in housing 10 such that upper surface 50*a* of electrolyzing unit 50 (one surface of electrolyzing unit 50 that is on the upper side in stacking direction Z) faces channel 11, as shown in FIGS. 2 and 3.

As shown in FIGS. 1 and 2, electrolyzing unit 50 has stacked structure 51. Stacked structure 51 has anode (electrode) 54, cathode (electrode) 55, and conductive film 56, which are stacked such that conductive film 56 is interposed between anode (electrode) 54 and cathode (electrode) 55, that is, interposed between a plurality of electrodes adjacent to each other.

Channel 11 has inlet 111 into which a liquid to be supplied to electrolyzing unit 50 flows, and outlet 112 from which ozonized water generated by electrolyzing unit 50 flows out. Channel 11 is formed in housing 10 such that liquid-flow direction X intersects stacking direction Z of stacked structure 51.

Figure 3:
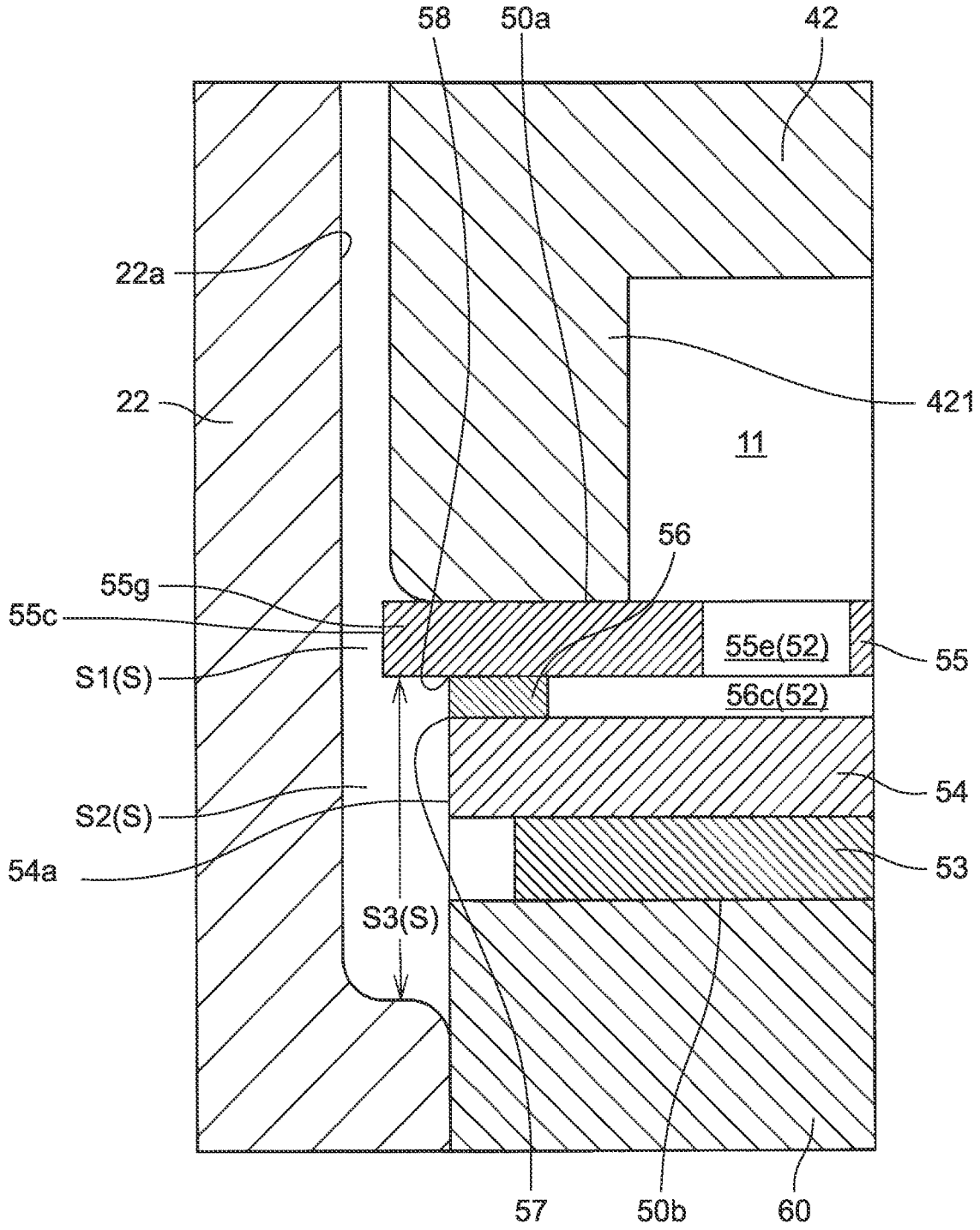
FIG. 3 is an enlarged sectional view of a part of an electrolyzing unit according to the one exemplary embodiment of the present disclosure, the part having a conductive film-side groove formed therein.

In stacked structure 51, grooves 52 are formed as grooves which are open to channel 11 and to which at least a part of interfaces 57 and 58 between conductive film 56 and the electrodes (anode 54 and cathode 55) is exposed (see FIG. 3). When at least one groove 52 is formed in stacked structure 51, groove 52 functions effectively.

Since grooves 52 are formed in stacked structure 51, water supplied from inlet 111 to channel 11 can be lead to grooves 52. Water lead to grooves 52 is subjected to electrolyzing that causes an electrochemical reaction, which creates ozonized water containing ozone as an electrogenerated product.

Housing 10 is made of, for example, a non-conductive resin, such as polyphenylene sulfide (PPS). According to the present exemplary embodiment, housing 10 has electrode case 20 and electrode case lid 40. Electrode case 20 has an opening on its top, and has recession 23 in which electrolyzing unit 50 is placed. Electrode case lid 40 covers the opening of electrode case 20.

As shown in FIG. 1, electrode case 20 has bottom wall 21 and peripheral wall 22 formed consecutively on a periphery of bottom wall 21, thus being formed substantially into a box shape with an open top. In other words, in electrode case 20, recession 23 is formed as a recession that is demarcated by inner surface 21*a* of bottom wall 21 and inner surface 22*a* of peripheral wall 22 and that has an open top.

Electrolyzing unit 50 is inserted from an opening side (upper side) into recession 23 and is therefore placed in recession 23. The opening of recession 23 is formed to be larger in outline than electrolyzing unit 50 in a view along stacking direction Z. This allows electrolyzing unit 50, of which the stacking direction matches the vertical direction (stacking direction Z), to be inserted into recession 23 as an original position of electrolyzing unit 50 is maintained.

According to the present exemplary embodiment, electrolyzing unit 50 is placed in recession 23 via elastic material 60. Specifically, electrolyzing unit 50 is placed in recession 23 such that elastic material 60 is interposed between electrolyzing unit 50 and electrode case 20 and that elastic material 60 is in contact with lower surface 50*b* of electrolyzing unit 50. Elastic material 60 is made of, for example, a material having elasticity, such as rubber, plastic, and metal spring.

According to the present exemplary embodiment, when electrode case lid 40 is attached to electrode case 20, channel 11 is formed between electrolyzing unit 50 and electrode case lid 40. It is preferable that channel 11 be formed such that sectional areas of its part facing electrolyzing unit 50 (areas of sections of channel 11 that are taken by cutting channel 11 along a plane perpendicular to liquid-flow direction X) are substantially equal at a plurality of locations on channel 11.

Electrode case lid 40 has lid body 41 of a substantially rectangular plate-like shape, and protrusion 42 that protrudes downward from a center of a lower part of lid body 41 and that is inserted in recession 23 of electrode case 20.

On a periphery of protrusion 42 of lid body 41, fitting recession 411 for welding is formed along the entire periphery. When electrode case lid 40 is attached to electrode case 20, fitting protrusion 241 for welding, which is formed along the entire periphery of the opening of electrode case 20, is inserted in fitting recession 411 (see FIG. 2).

According to the present exemplary embodiment, flange 24, which extends outward substantially in the horizontal direction, is formed consecutively on an upper end of peripheral wall 22 of electrode case 20 to extend along the whole of peripheral wall 22. On flange 24, fitting protrusion 241, which protrudes upward, is formed in such a way as to encircle the opening of electrode case 20. Protrusion 42 is inserted in recession 23 as fitting protrusion 241 is inserted in fitting recession 411. In this state, electrode case lid 40 and electrode case 20 are welded together.

It is possible that electrode case lid 40 is attached to electrode case 20 by screwing electrode case lid 40 onto electrode case 20 as a sealing material is interposed between electrode case lid 40 and electrode case 20.

On both ends and a center in width direction Y of a lower surface of protrusion 42, protrusions 421 are formed, respectively, protrusions 421 pushing electrolyzing unit 50 downward. When electrolyzing unit 50 is placed in recession 23 via elastic material 60 and electrode case lid 40 is attached to electrode case 20, protrusions 421 formed on electrode case lid 40 pushes electrolyzing unit 50 downward.

In this manner, according to this exemplary embodiment, when electrolyzing unit 50 is pushed downward, fixed pressure is applied by elastic material 60 to the whole of electrolyzing unit 50. This enhances a state of adherence of components making up electrolyzing unit 50.

According to the present exemplary embodiment, elastic material 60 has a plurality of through-holes 61 penetrating elastic material 60 in stacking direction Z and being lined up in the lengthwise direction (liquid-flow direction X). Because of this structure, when pushed down by electrolyzing unit 50, elastic material 60 is allowed to deform toward through-holes 61. In this manner, allowing elastic material 60 to deform toward through-holes 61 inhibits elastic material 60 pushed down by electrolyzing unit 50 from putting pressure on electrode case 20.

According to the present exemplary embodiment, grooves 412 are formed on an upper surface of lid body 41. These grooves 412 are used to position ozonized water generator 1 or prevent it from being caught by other components or being inserted in an inverted position when ozonized water generator 1 is fixed. By providing ozonized water generator 1 with grooves 412, ozonized water generator 1 can be incorporated in an apparatus requiring an ozone generation function more easily without an error.

Ozonized water generator 1 is incorporated in a different apparatus or equipment and is used in such a state. It is preferable that when ozonized water generator 1 is incorporated in a different apparatus or equipment, ozonized water generator 1 be set in a standing position in which inlet 111 is located on the lower side while outlet 112 is located on the upper side. If ozonized water generator 1 is set with its inlet 111 located on the lower side and outlet 112 located on the upper side, ozone generated at electrode interfaces can be separated quickly by buoyancy, from the electrode interfaces. In other words, ozone generated at the electrode interfaces can be separated quickly from the electrode interfaces before ozone grow into bubbles of ozone. As a result, ozone tends to dissolve into water swiftly, which improves ozonized water generation efficiency. The setting position of ozonized water generator 1 is not limited to the above position, and ozonized water generator 1 may be set properly in other positions.

A specific configuration of electrolyzing unit 50 will then be described.

Electrolyzing unit 50 is of a substantially rectangular shape of which the lengthwise direction matches liquid-flow direction X in a plan view (view in stacking direction Z). Electrolyzing unit 50 has stacked structure 51 formed by stacking anode 54, conductive film 56, and cathode 55 in increasing order. In this manner, according to this exemplary embodiment, stacked structure 51 is formed such that conductive film 56 is interposed between anode 54 and cathode 55 that are the electrodes adjacent to each other.

Under anode 54, feeder 53 is disposed. Via this feeder 53, electricity is supplied to anode 54.

According to the present exemplary embodiment, in a plan view, each of feeder 53, anode 54, conductive film 56, and cathode 55 is of a tabular shape having a rectangular plane, of which a lengthwise direction matches liquid-flow direction X and a widthwise direction matches width direction Y, and having a thickness in stacking direction Z. At least either anode 54 or cathode 55 may be of a film-like, meshed, or linear form.

Feeder 53 may be made of, for example, titanium. Feeder 53 is in contact with a side of anode 54 that is opposite to a side of anode 54 that is in contact with conductive film 56. To one end in the lengthwise direction of feeder 53 (upstream side in liquid-flow direction X), feeder shaft **53*b* for anode is electrically connected via spiral spring 53*a*. Feeder shaft 53*b* is inserted in though-hole 211 formed on one end in liquid-flow direction X of bottom wall 21. A part of feeder shaft 53*b* that projects out of electrode case 20** is electrically connected to a positive electrode of a power supply unit (not depicted).

Anode 54 is formed by, for example, coating a conductive substrate, which is made of silicon and is about 10 mm in width and 100 mm in length, with a conductive diamond film. In another case, for example, a pair of conductive substrates each of which is about 10 mm in width and 50 mm in length may be used together to form anode 54. The conductive diamond film has boron-doped conductivity. The conductive diamond film of about 3 μm in thickness is deposited on the conductive substrate by plasma chemical vapor deposition (plasma CVD).

Conductive film 56 is disposed on anode 54 having the conductive diamond film deposited on the conductive substrate. Conductive film 56 is a proton-conducting ion-exchange film, having a thickness ranging from 100 μm to 200 μm. Conductive film 56 has a plurality of conductive film-side holes (conductive film-side grooves) **56*c* penetrating conductive film 56 in its thickness direction (stacking direction Z) (see FIG. 5**).

According to the present exemplary embodiment, each of conductive film-side holes **56*c* is substantially the same in shape. Specifically, each of conductive film-side holes 56*c* is an elongated hole that is long and narrow in width direction Y. Conductive film-side holes 56*c* are lined up at a given pitch along the lengthwise direction (liquid-flow direction X). Conductive film-side holes 56*c* may be of a shape and in arrangement that are different from the shape and arrangement shown in FIG. 5. When at least one conductive film-side hole 56*c* is formed, conductive film-side hole 56*c*** functions effectively.

Cathode 55 is disposed on conductive film 56. Cathode 55 is provided as, for example, a titanium electrode plate of about 0.5 mm in thickness. To the other end in the lengthwise direction of cathode 55 (downstream side in liquid-flow direction X), feeder shaft 55*b* for cathode is electrically connected via spiral spring 55*a*. Feeder shaft 55*b* is inserted in though-hole 211 formed on the other end in in liquid-flow direction X of bottom wall 21. A part of feeder shaft 55*b* that projects out of electrode case 20 is electrically connected to a negative electrode of the power supply unit (not depicted).

Figure 6:
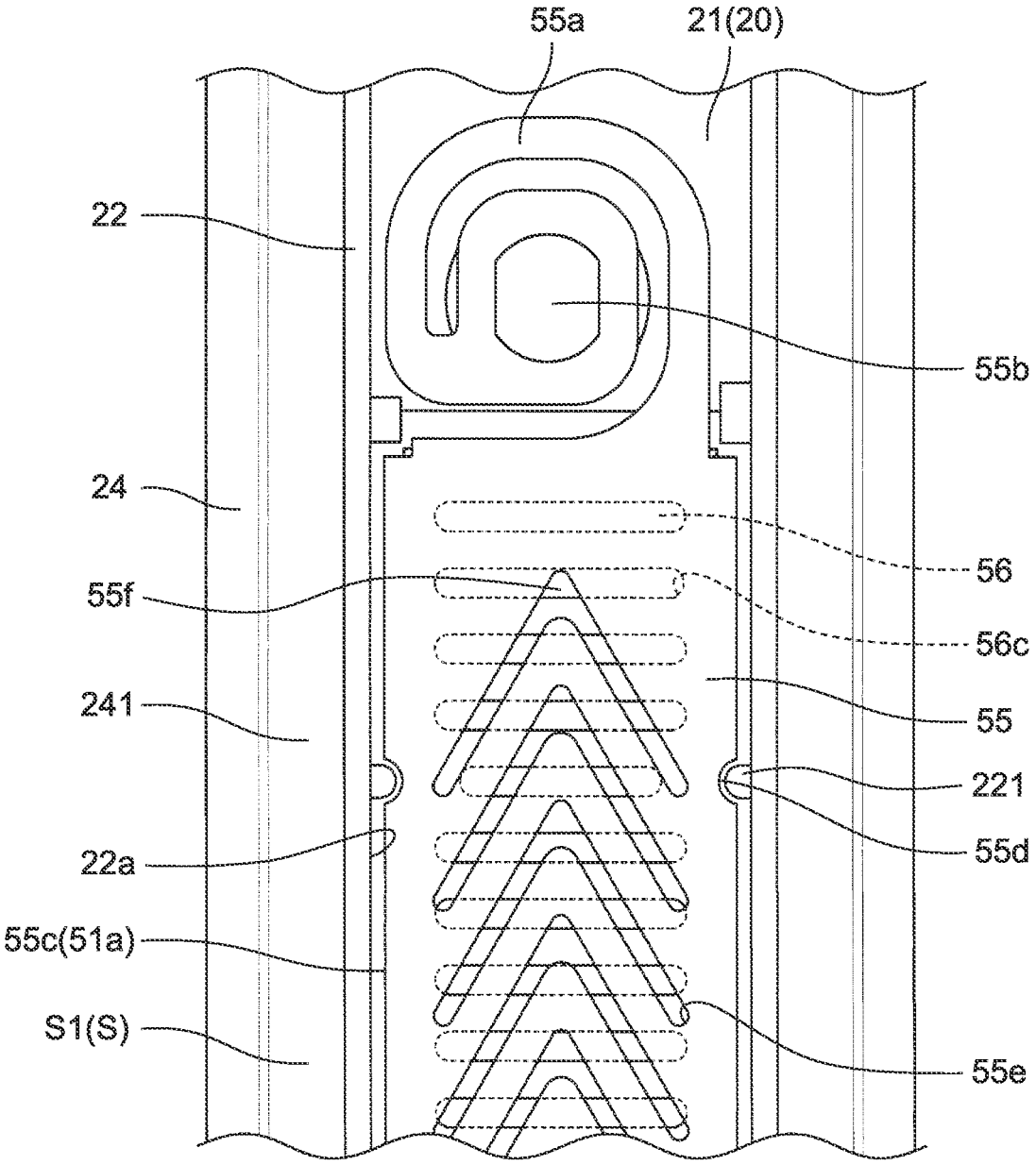
FIG. 6 is an enlarged plan view of a part of a cathode stacked on the conductive film, according to the one exemplary embodiment of the present disclosure.

Cathode 55 has a plurality of cathode-side holes (cathode-side grooves, i.e., electrode-side grooves) 55*e* penetrating cathode 55 in its thickness direction (see FIG. 6). According to this exemplary embodiment, each of cathode-side holes 55*e* is substantially the same in shape. Specifically, in a plan view, each cathode-side hole 55*e* is of a V shape in which a bent portion 55*f* is located on the downstream side.

Cathode-side holes 55*e* are lined up at a given pitch along the lengthwise direction (liquid-flow direction X).

The pitch of cathode-side holes 55*e* may be equal to the pitch of conductive film-side holes 56*c* or may be different from the same. Cathode-side holes 55*e* may be of a shape and in arrangement that are different from the shape and arrangement shown in FIG. 6. When at least one cathode-side hole 55*e* is formed, cathode-side hole 55*e* functions effectively.

In this manner, according to the present exemplary embodiment, conductive film-side holes 56*c* and cathode-side holes 55*e* are different in shape (at least in outline or size) from each other in a plan view (view along the stacking direction of stacked structure 51). In this structure, even if conductive film 56 is shifted against cathode (electrode) 55 relatively in a direction intersecting stacking direction Z, a change in a contact area between conductive film 56 and cathode (electrode) 55 can be suppressed. It is possible to make conductive film-side holes 56*c* and cathode-side holes 55*e* equal in shape (in outline and size) with each other in a plan view.

It is necessary that when conductive film 56 and cathode 55 are stacked, at least some of their holes (conductive film-side holes 56*c* and cathode-side holes 55*e*) communicate with each other and a sufficient electrical contact area between them be secured. If conductive film 56 and cathode 55 meet the above condition, they may be equal or different in projection dimensions (size in a plan view) with each other or from each other.

According to the present exemplary embodiment, cathode 55 is larger in width in width direction Y than conductive film 56 (see FIG. 3).

Projection dimensions of anode 54 may be equal to projection dimensions of at least either conductive film 56 or cathode 55 or may be different from the same. It is nevertheless preferable that anode 54 have a size that allows it to cover conductive film-side holes 56*c* from below when anode 54 is stacked.

According to the present exemplary embodiment, anode 54 and conductive film 56 are substantially equal in projection dimensions with each other.

It is preferable that feeder 53 be capable of supplying electricity efficiently to anode 54 and that elastic material 60 have projection dimensions that subject elastic material 60 to pressurization by the whole of a lower surface of feeder 53 (lower surface 50*b* of electrolyzing unit 50).

According to the present exemplary embodiment, a dimension of feeder 53 in width direction Y is made smaller than that of anode 54 and of conductive film 56, while a dimension of elastic material 60 in width direction Y is made substantially equal to that of anode 54 and of conductive film 56. Projection dimensions of feeder 53 and elastic material 60 may be determined to be various dimensions.

Electrolyzing unit 50 configured in this manner can be placed in recession 23 of electrode case 20, for example, by the following method.

First, feeder 53 is disposed on elastic material 60 inserted in recession 23 of electrode case 20. Specifically, feeder 53 with feeder shaft 53*b* having its front end directed downward is put in recession 23 of electrode case 20. Then, feeder shaft 53*b* is inserted into one through-hole 211 to stack feeder 53 on elastic material 60.

Subsequently, anode 54 is put in recession 23 of electrode case 20 to stack anode 54 on feeder 53.

Subsequently, conductive film 56 is put in recession 23 of electrode case 20 to stack conductive film 56 on anode 54.

Subsequently, cathode 55 with feeder shaft 55*b* having its front end directed downward is put in recession 23 of electrode case 20 as feeder shaft 55*b* is inserted into the other through-hole 211. Cathode 55 is thus stacked on conductive film 56.

Subsequently, the part of feeder shaft 53*b* for anode, the part projecting out of electrode case 20, and the part of feeder shaft 55*b* for cathode, the part projecting out of electrode case 20, are inserted into O-rings 31, washers 32, wavy washers 33, and hexagon nuts 34, respectively.
By tightening hexagon nuts 34, electrolyzing unit 50 is placed and fixed in recession 23 in a state in which electrolyzing unit 50 is pushed against elastic material 60.

According to the present exemplary embodiment, electrode case lid 40 is moved relatively toward electrode case 20 in stacking direction Z. As a result, protrusion 42 is inserted in recession 23 as fitting protrusions 241 are inserted in fitting recessions 411 for welding.

In this manner, ozonized water generator 1 according to the present exemplary embodiment can be assembled by merely moving each component relatively toward electrode case 20 in the vertical direction (stacking direction Z).

Operations and effects of ozonized water generator 1 will then be described.

To supply ozonized water generator 1 with water, water is fed through inlet 111 into channel 11. Part of water fed to channel 11 flows into grooves 52 and comes in contact with interfaces 57 and 58 of grooves 52.

In this state (state in which electrolyzing unit 50 is immersed in supplied water), the power supply unit (not depicted) applies a voltage across anode 54 and cathode 55 of electrolyzing unit 50. This creates a potential difference between anode 54 and cathode 55 via conductive film 56. The potential difference created between anode 54 and cathode 55 generates a current flowing through anode 54, conductive film 56, and cathode 55. As a result, an electrolyzing process takes place mainly in water in grooves 52, leading to creation of ozone near interface 57 between conductive film 56 and anode 54.

Ozone created near interface 57 between conductive film 56 and anode 54 is carried by waterflow toward the downstream side of channel 11, during which ozone dissolves into water. Ozone is caused to dissolves into water in this manner. Hence dissolved ozonized water (ozonized water, i.e., electrolytic solution) is generated.

Ozonized water generator 1 can be applied to electrical equipment that uses an electrolytic solution generated by an electrolytic solution generator and to liquid reformer or the like equipped with an electrolytic solution generator.

Such electrical equipment and liquid reformers include water processing equipment, such as water purifiers, washing machines, dish washers, washlets, refrigerators, water heaters/servers, sterilizers, medical instruments, air conditioners, and kitchen utensils.

According to the present exemplary embodiment, pressure application to peripheral wall 22 (housing 10) and electrolyzing unit 50 by scales produced by water electrolyzation is inhibited.

Specifically, space S is formed between an outer periphery of at least either cathode 55 or anode 54 and inner surface 22*a* of peripheral wall 22 (inner surface of housing 10), and this space S inhibits water from staying on a periphery of electrolyzing unit 50.

By forming space S for letting water flow between the periphery of electrolyzing unit 50 and peripheral wall 22 (inner surface of housing 10), water stagnation on the periphery of electrolyzing unit 50 is inhibited. Space S has a gap larger than a manufacturing tolerance that arises when ozonized water generator 1 is assembled.

According to the present exemplary embodiment, as described above, cathode 55 is larger in width in width direction Y than conductive film 56. Anode 54 and conductive film 56 are substantially equal in projection dimensions with each other.

When stacked structure 51 is formed, both ends in width direction Y of cathode 55 protrude to be further outside than those of anode 54 and conductive film 56.

In other words, outer periphery (side face) 55*c* of cathode 55 protrudes to be further outside in width direction Y (direction intersecting stacking direction Z) than outer periphery (side face) 54*a* of anode 54. A part of cathode 55 that protrudes to be further outside in width direction Y than outer periphery 54*a* of anode 54 is defined as cathode-side protrusion 55*g* (see FIG. 3). In this manner, if cathode-side protrusion 55*g*, which protrudes to be further outside than respective ends of anode 54 and conductive film 56, are formed on both ends in width direction Y of cathode 55, space S is formed between inner surface 22*a* of peripheral wall 22 and anode 54 when stacked structure 51 is placed in recession 23. Space S is formed also in an area below cathode-side protrusion 55*g* of cathode 55 (area closer to anode 54 in stacking direction Z).

According to the present exemplary embodiment, space S has anode-side space (second space) S2 formed between outer periphery (side face) 54*a* of anode 54 and inner surface 22*a* of peripheral wall 22 (inner surface of housing 10). Space S has also lower-side space (third space) S3 formed in an area closer to anode 54 than to cathode 55 in stacking direction Z.

According to the present exemplary embodiment, in a state in which cathode-side protrusion 55*g* is formed, a gap larger than the manufacturing tolerance is formed also between outer periphery (side face) 55*c* of cathode 55 and inner surface 22*a* of peripheral wall 22 (inner surface of housing 10). In other words, space S has cathode-side space (first space) 51 formed between outer periphery (side face) 55*c* of cathode 55 and inner surface 22*a* of peripheral wall 22 (inner surface of housing 10).

In this manner, according to the present exemplary embodiment, space S having cathode-side space (first space) 51, anode-side space (second space) S2, and lower-side space (third space) S3 is formed between outer periphery (side face) 51*a* of stacked structure 51 and inner surface 22*a* of peripheral wall 22.

According to the present exemplary embodiment, space S is formed at least on the periphery in the lengthwise direction of stacked structure 51. In other words, at least a part of cathode-side space (first space) S1 is formed along side faces 51*a*. Side faces 51*a* are on both sides in width direction Y of stacked structure 51, respectively, and extend in the lengthwise direction (liquid-flow direction X).

It is preferable that cathode-side space (first space) S1 communicate with inlet 111 and with outlet 112 and cause water lead to cathode-side space (first space) S1 to efficiently flow out of outlet 112. However, cathode-side space (first space) S1 may communicate with channel 11 at its midpoint.

Forming such space S inhibits scales made of a calcium component or the like, the scales being produced by water electrolyzation, from piling up between stacked structure 51 and peripheral wall 22.

For example, vicinity of interface 58 between conductive film 56 and cathode 55 is an area where a pH value tends to rise and therefore scales tend to develop. However, forming space S described in the present exemplary embodiment creates a relatively large space near interface 58. Specifically, an outer part of interface 58 in width direction Y is exposed to space S in a state in which a space of a give size (lower-side space, i.e., third space S3) is formed in an area (lower side) closer to anode 54 in stacking direction Z and a space of a given size (anode-side space, i.e., second space S2) is formed outside anode 54 in width direction Y.

According to the present exemplary embodiment, the outer part of interface 58 in width direction Y is exposed to space S along the lengthwise direction (liquid-flow direction X), which means that almost the entire outer part of interface 58 in width direction Y is exposed to space S.

As a result, water lead into space S flows downstream along the liquid-flow direction X. This means that water lead to the vicinity of interface 58 exposed to space S also flows downstream relatively quickly along the liquid-flow direction X. This waterflow, therefore, carries scales produced near interface 58 away to the downstream side before scales stick to stacked structure 51 and housing 10. In this manner, forming space S described in the present exemplary embodiment inhibits water from staying near interface 58, where scales tend to be produced, and allows water to carry scales produced near interface 58 away quickly to the downstream side. This inhibits piling of scales between stacked structure 51 and peripheral wall 22. Hence pressure application by scales to peripheral wall 22 (housing 10) and electrolyzing unit 50 is inhibited.

It should be noted, however, that although forming space S inhibits piling of scales between stacked structure 51 and peripheral wall 22, a relatively small amount of scales stick to stacked structure 51 and peripheral wall 22, nevertheless. When ozonized water generator 1 is used for a long period, therefore, scales sticking to stacked structure 51 and peripheral wall 22 may grow bigger and put pressure onto peripheral wall 22 (housing 10) and electrolyzing unit 50. It is preferable for this reason that space S be given a size large enough to an extent that even when ozonized water generator 1 is used in a period longer than its service life by an ordinary use method, sticking scales do not block up space S. The ordinary use method is determined based on, for example, quality of water (quality of a liquid) supplied into the housing, an average flow velocity/flow rate of water flowing through the housing, ozone generation efficiency (voltage applied across the electrodes and an electrolyzation area), and an estimated service frequency.

Figure 4:
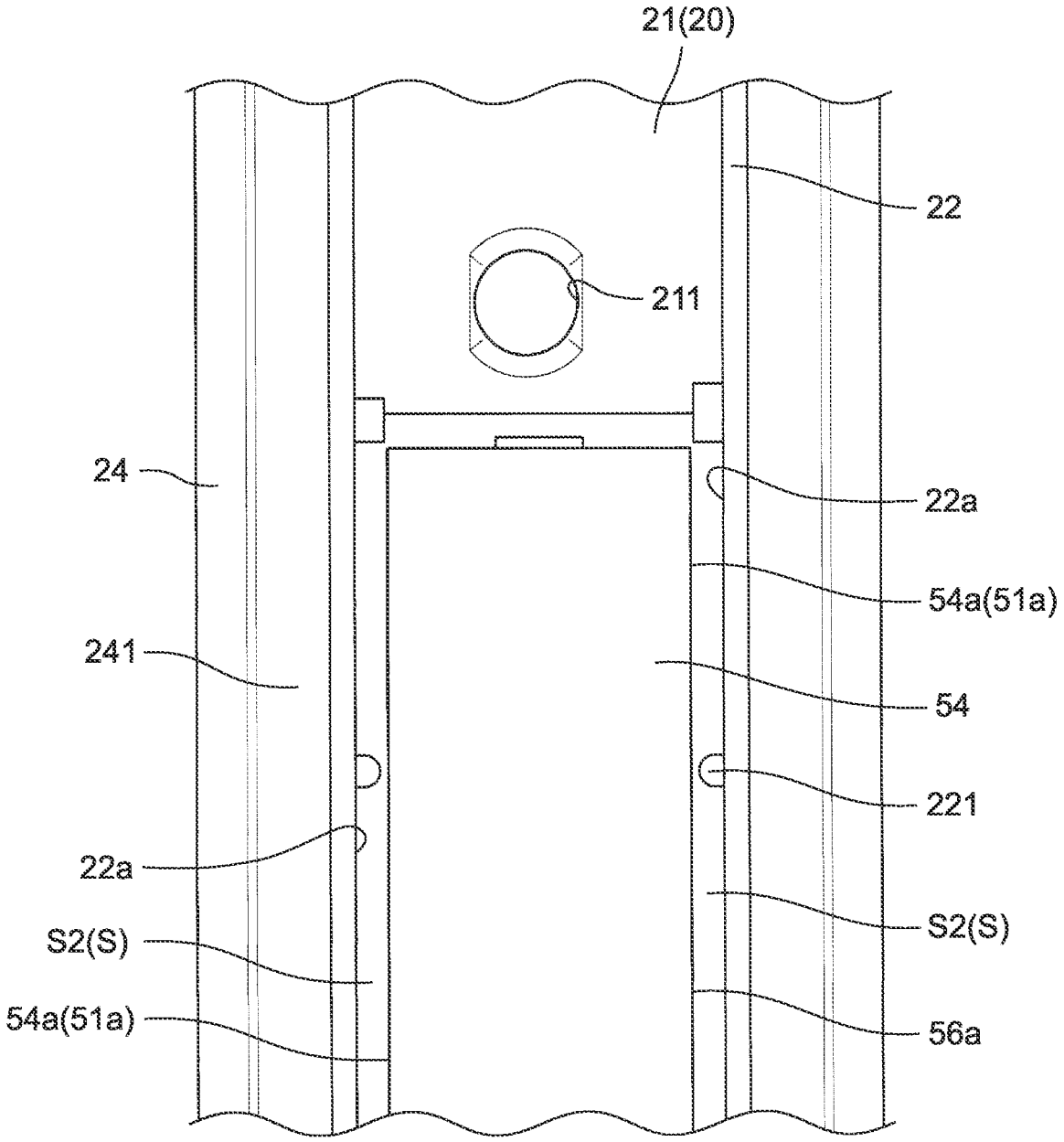
FIG. 4 is an enlarged plan view of a part of an anode stacked on a feeder, according to the one exemplary embodiment of the present disclosure.

On the interior of peripheral wall 22 of electrode case 20, a plurality of positioning protrusions 221 extending in the vertical direction (stacking direction Z) are formed along the lengthwise direction (liquid-flow direction X) (see FIG. 4). These positioning protrusions 221 inhibit a positional shift of anode 54 when anode 54 is stacked (see FIG. 4). According to the present exemplary embodiment, positioning protrusions 221 are formed on a part of the inner surface of peripheral wall 22 (inner surface of the housing), the part being counter to outer periphery 51*a* of stacked structure 51. Positioning protrusions 221 are equivalent to housing protrusions protruding toward stacked structure 51.

As a result of formation of positioning protrusions (housing protrusions) 221 on peripheral wall 22, when stacked structure 51 is just placed in recession 23, space S is formed between outer periphery (side face) 51*a* of stacked structure 51 and inner surface 22*a* of peripheral wall 22.

Figure 5:
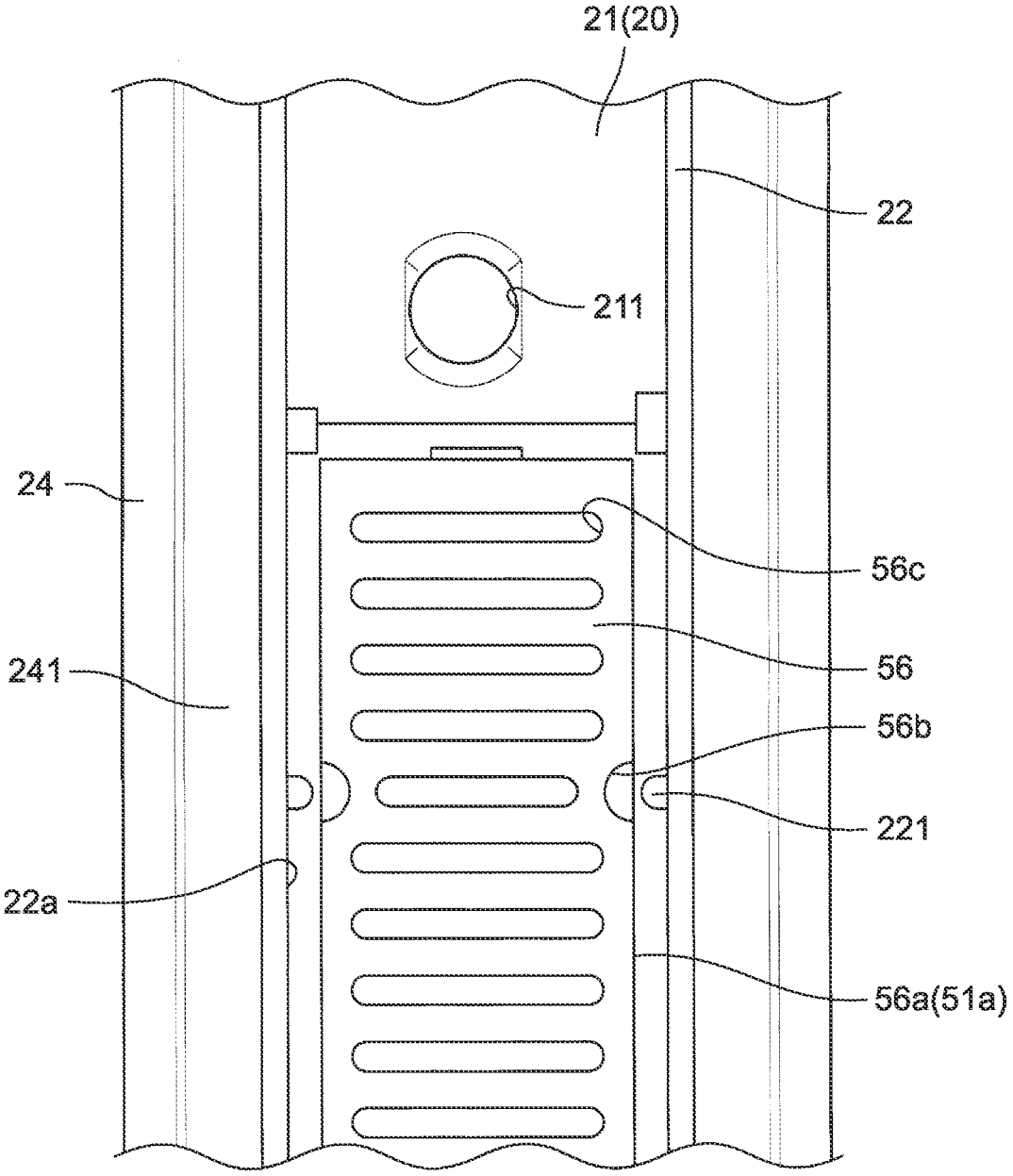
FIG. 5 is an enlarged plan view of a part of a conductive film stacked on the anode, according to the one exemplary embodiment of the present disclosure.

According to the present exemplary embodiment, conductive film-side recessions 56*b*, which serve as relief portions, are formed on outer periphery (side face) 56*a* of conductive film 56 (outline of conductive film 56 in a plan view) (see FIG. 5). Conductive film-side recessions 56*b* are formed on part of conductive film 56 that correspond to positioning protrusions (housing protrusions) 221 when stacked structure 51 is placed in recession 23.

When conductive film 56 is put in recession 23 and is stacked on anode 54, therefore, conductive film-side recessions 56*b* are set counter to positioning protrusions 221 of peripheral wall 22 (see FIG. 5). Because of this structure, when ozonized water is generated, conductive film 56 having swollen due to its absorption of water is inhibited from interfering with positioning protrusions 221.

Cathode-side recessions 55*d*, which serve as relief portions, are formed on outer periphery (side face) 55*c* of cathode 55 (outline in a plan view), which is larger in width in width direction Y than conductive film 56 (see FIG. 6). Cathode-side recessions 55*d* are formed on part of cathode 55 that correspond to positioning protrusions (housing protrusions) 221 when stacked structure 51 is placed in recession 23.

When cathode 55 is put in recession 23 and is stacked on conductive film 56, therefore, cathode-side recessions 55*d* are set counter to positioning protrusions 221 of peripheral wall 22 (see FIG. 6). Because of this structure, cathode 55, which is larger in dimension in width direction Y, is inhibited from interfering with positioning protrusions 221. In other words, cathode-side recessions 55*d* are formed so that interference between cathode 55 and positioning protrusions 221 is inhibited as a surface area of cathode 55 is made larger as much as possible.

Space S is effective if it is formed between the outer periphery of at least either cathode 55 or anode 54 and inner surface 22*a* of peripheral wall 22 (inner surface of housing 10). For example, stacked structure 51 may have configurations shown in FIGS. 7 to 11.

Modifications of space S according to the present exemplary embodiment will hereinafter be described.

Figure 7:
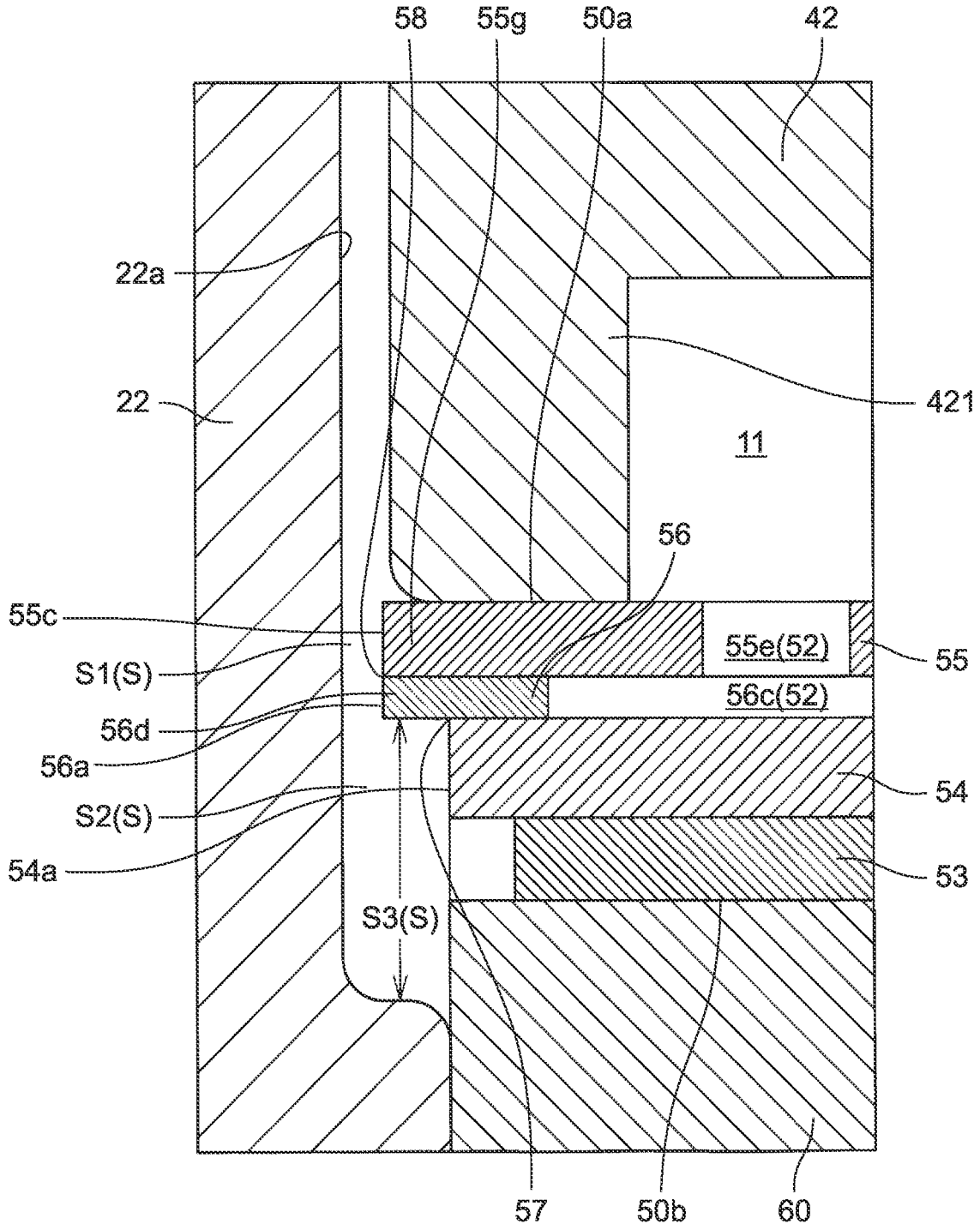
FIG. 7 is an enlarged view of a part of an electrolyzed water generator according to a first modification of the present disclosure, showing a sectional view corresponding to the sectional view of FIG. 3.

FIG. 7 depicts stacked structure 51 in which outer periphery (side face) 56*a* of conductive film 56 protrude to be further outside in width direction Y (direction intersecting stacking direction Z) than outer periphery (side face) 54*a* of anode 54. A part of conductive film 56 that protrude to be further outside in width direction Y than outer periphery (side face) 54*a* of anode 54 is defined as conductive film-side protrusion 56*d*.

In FIG. 7, cathode 55 and conductive film 56 are substantially equal in projection dimensions with each other.

In this manner, in FIG. 7, cathode-side protrusion 55*g* protruding to be further outside than the outer periphery of anode 54 is formed on both sides in width direction Y of cathode 55 as conductive film-side protrusion 56*d* protruding to be further outside than the outer periphery of anode 54 is formed on both sides in width direction Y of conductive film 56. As a result, when stacked structure 51 is placed in recession 23, space S having cathode-side space (first space) S1, anode-side space (second space) S2, and lower-side space (third space) S3 is formed between outer periphery (side face) 51*a* of stacked structure 51 and inner surface 22*a* of peripheral wall 22.

This configuration also inhibits piling of scales between stacked structure 51 and peripheral wall 22.

As a result of expanding conductive film 56 to both ends in width direction Y of cathode 55, conductive film 56 comes in contact also with lower surfaces of cathode-side protrusions 55*g*. This allows more effective use of an increased area of cathode 55. This means that the contact area (electrolyzation area) between cathode 55 and conductive film 56 is further increased.

Figure 8:
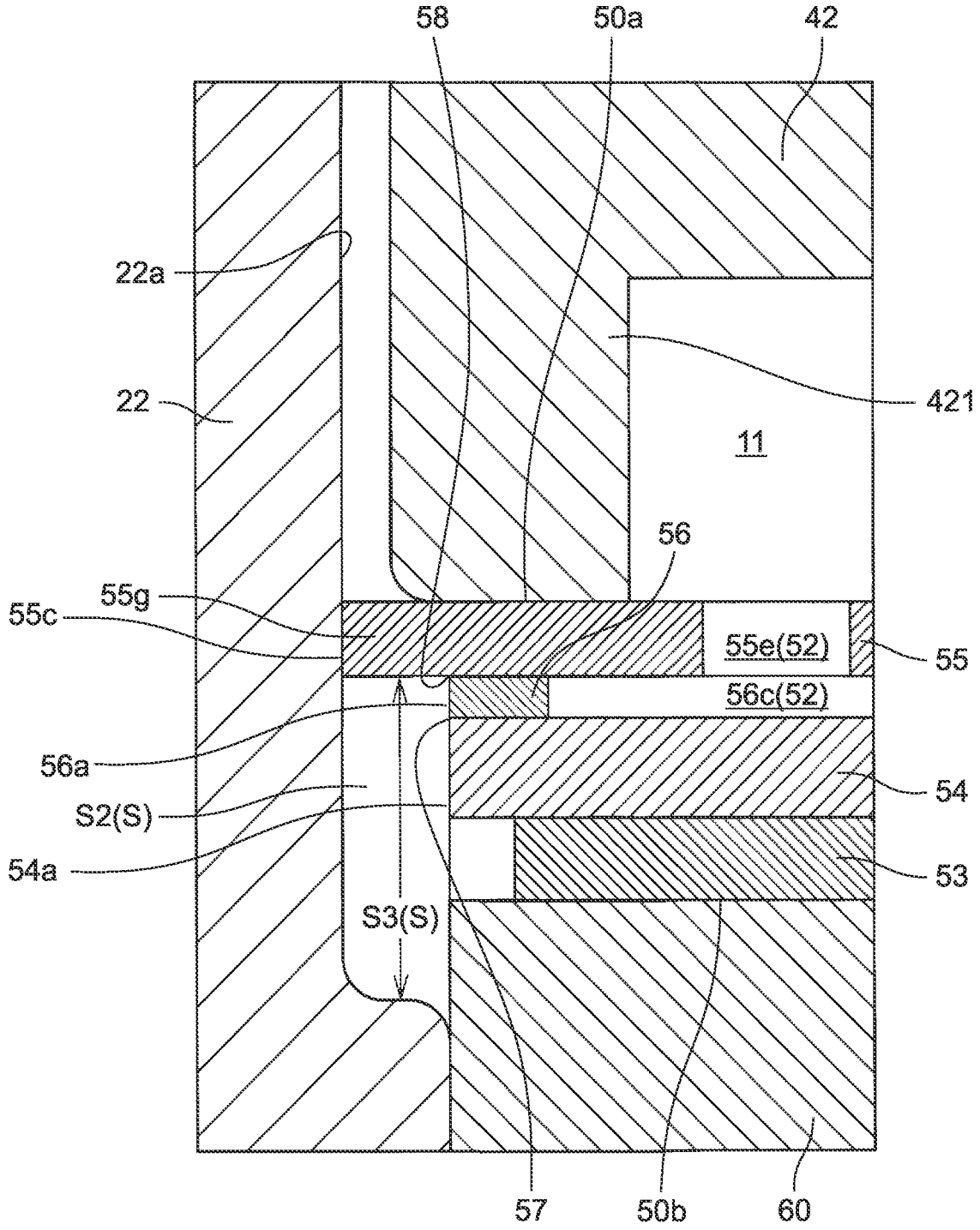
FIG. 8 is an enlarged view of a part of an electrolyzed water generator according to a second modification of the present disclosure, showing a sectional view corresponding to the sectional view of FIG. 3.

FIG. 8 depicts stacked structure 51 in which cathode-side protrusion 55*g*, which protrudes to be further outside than respective outer peripheries of anode 54 and conductive film 56, is formed on both sides in width direction Y of cathode 55 in the same manner as in stacked structure 51 described in the present exemplary embodiment.

Outer periphery (side face extending along the lengthwise direction) 55*c* of cathode 55 is in contact with inner surface 22*a* of peripheral wall 22, and space S is formed between outer periphery 54*a* of anode 54, outer periphery 56*a* of conductive film 56 and inner surface 22*a* of peripheral wall 22. In other words, when stacked structure 51 is placed in recession 23, space S having anode-side space (second space) S2 and lower-side space (third space) S3 is formed between outer periphery (side face) 51*a* of stacked structure 51 and inner surface 22*a* of peripheral wall 22.

This configuration also inhibits piling of scales between stacked structure 51 and peripheral wall 22.

In the configuration shown in FIG. 8 (configuration in which outer periphery 55*c* of cathode 55 is brought into contact with inner surface 22*a* of peripheral wall 22), conductive film-side protrusion 56*d* shown in FIG. 7 can be formed on conductive film 56. Bring conductive film-side protrusion 56*d* into contact with inner surface 22*a* of peripheral wall 22, however, raises a concern that water may stay in the area between interface 58 and inner surface 22*a* of peripheral wall 22, where scales tend to develop. It is preferable for this reason that when conductive film-side protrusion 56*d* is formed, a gap with an adequate size for inhibiting water stagnation (space 5) be formed between outer periphery 56*a* of conductive film 56 and inner surface 22*a* of peripheral wall 22.

Figure 9:
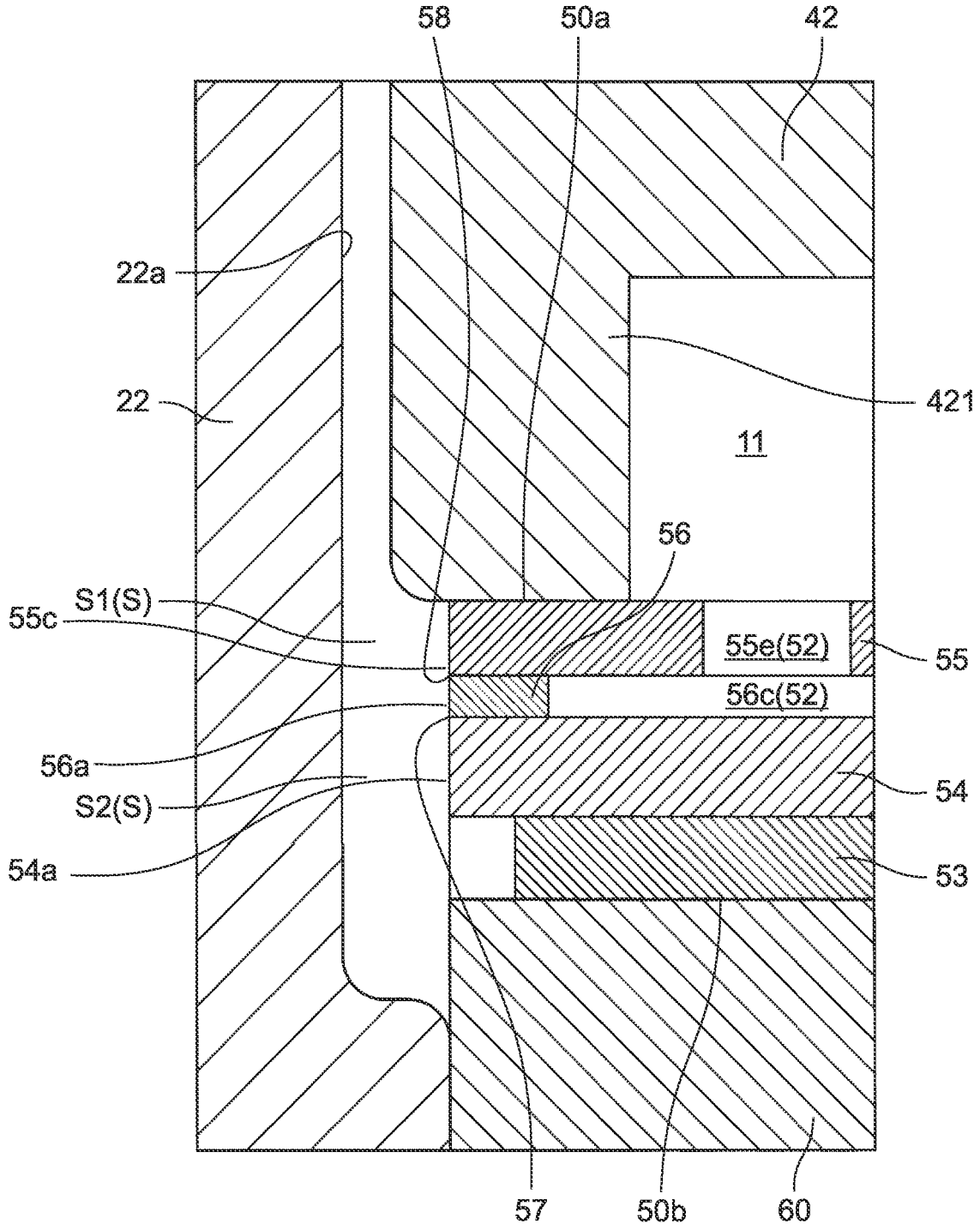
FIG. 9 is an enlarged view of a part of an electrolyzed water generator according to a third modification of the present disclosure, showing a sectional view corresponding to the sectional view of FIG. 3.

FIG. 9 depicts stacked structure 51 in which at least a part of outer periphery 54*a* of anode 54 that extends in the lengthwise direction, a part of outer periphery 55*c* of cathode 55 that extends in the lengthwise direction, and a part of outer periphery 56*a* of conductive film 56 that extends in the lengthwise direction are substantially flush with each other. Space S is formed between side face 54*a* of anode 54 that extends lengthwise, side face 55*c* of cathode 55 that extends lengthwise, side face 56*a* of conductive film 56 that extends lengthwise and inner surface 22*a* of peripheral wall 22. In other words, when stacked structure 51 is placed in recession 23, space S having cathode-side space (first space) 51 and anode-side space (second space) S2 is formed between outer periphery (side face) 51*a* of stacked structure 51 and inner surface 22*a* of peripheral wall 22.

This configuration also inhibits piling of scales between stacked structure 51 and peripheral wall 22.

Figure 10:
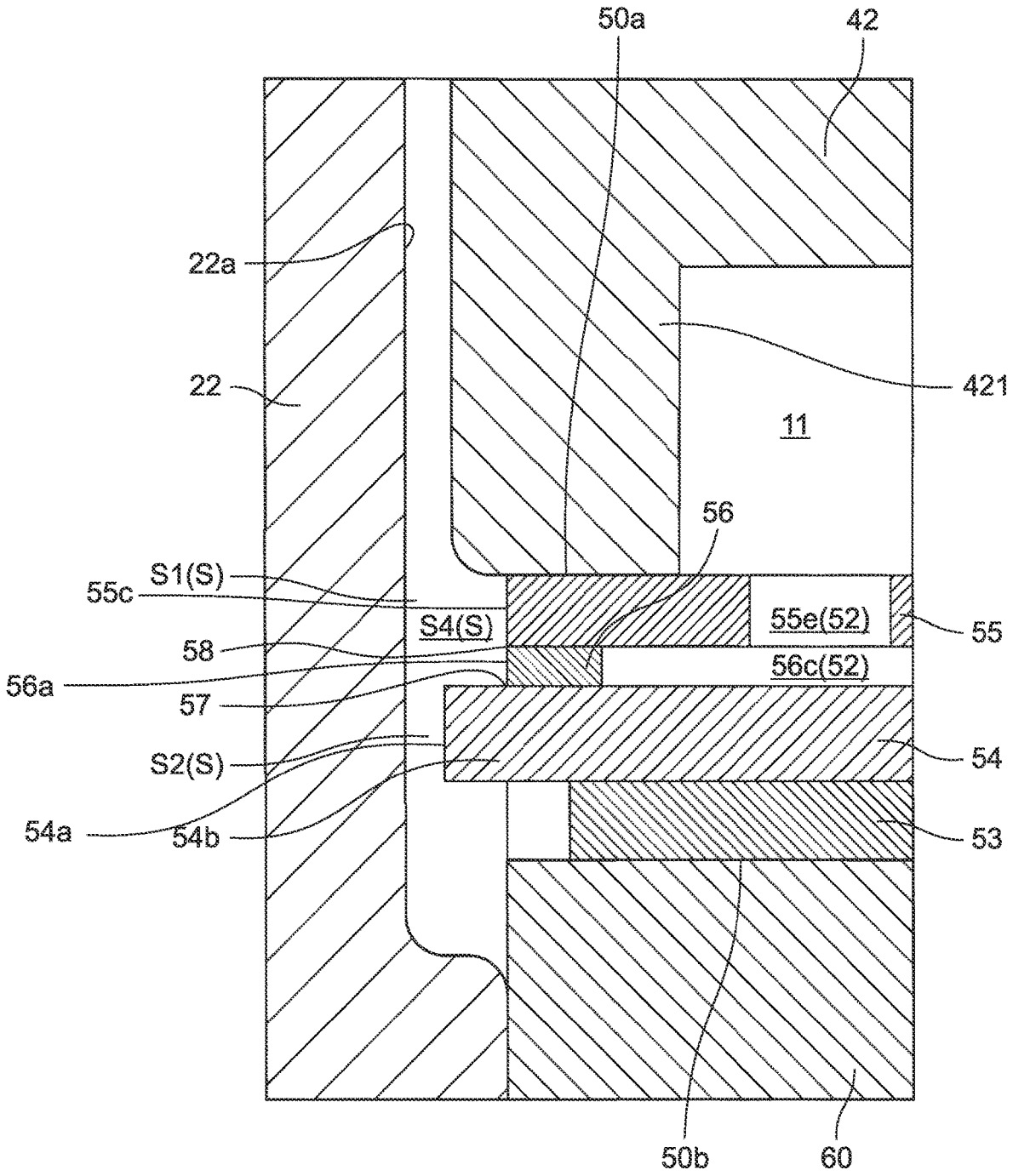
FIG. 10 is an enlarged view of a part of an electrolyzed water generator according to a fourth modification of the present disclosure, showing a sectional view corresponding to the sectional view of FIG. 3.

FIG. 10 depicts stacked structure 51 in which the size in width direction Y of anode 54 is made large than that of conductive film 56, and cathode 55 and conductive film 56 are made substantially equal in projection dimensions with each other.

When this stacked structure 51 is formed, both ends in width direction Y of anode 54 are protruded to be further outside than both ends of cathode 55 and of conductive film 56, and a part of anode 54 that protrudes to be further outside in width direction Y than outer periphery 55*c* of cathode 55 is defined as anode-side protrusion 54*b*.

In this manner, if anode-side protrusion 54*b*, which protrudes to be further outside than the outer periphery of cathode 55 and of conductive film 56, is formed on both ends in width direction Y of anode 54, space S is formed between inner surface 22*a* of peripheral wall 22 and cathode 55 when stacked structure 51 is placed in recession 23. Space S is formed also in an area above anode-side protrusion 54*b* of anode 54 (area closer to cathode 55 in stacking direction Z).

In this manner, in FIG. 10, space S has cathode-side space (first space) 51 formed between outer periphery (side face) 55*c* of cathode 55 and inner surface 22*a* of peripheral wall 22 (inner surface of housing 10). Space S has also upper-side space (fourth space) S4 formed in an area closer to cathode 55 than to anode 54 in stacking direction Z.

In FIG. 10, in a state in which anode-side protrusion 54*b* is formed, a gap larger than the manufacturing tolerance is formed also between outer periphery (side face) 54*a* of anode 54 and inner surface 22*a* of peripheral wall 22 (inner surface of housing 10). In other words, space S has anode-side space (second space) S2 formed between outer periphery (side face) 54*a* of anode 54 and inner surface 22*a* of peripheral wall 22 (inner surface of housing 10).

In this manner, in FIG. 10, space S having cathode-side space (first space) S1, anode-side space (second space) S2, and upper-side space (fourth space) S4 is formed between outer periphery (side face) 51*a* of stacked structure 51 and inner surface 22*a* of peripheral wall 22.

This configuration also inhibits piling of scales between stacked structure 51 and peripheral wall 22.

In the configuration shown in FIG. 10, conductive film-side protrusion 56*d* depicted in FIG. 7 can be formed on conductive film 56. Specifically, conductive film-side protrusion 56*d* protruding to be further outside than the outer periphery of cathode 55 can be formed on both sides in width direction Y of conductive film 56 as anode-side protrusion 54*b* protruding to be further outside than the outer periphery of cathode 55 is formed on both sides in width direction Y of anode 54.

This configuration also inhibits piling of scales between stacked structure 51 and peripheral wall 22.

As a result of expanding conductive film 56 to both ends in width direction Y of anode 54, conductive film 56 comes in contact also with upper surfaces of anode-side protrusions 54*b*. This allows more effective use of an increased area of anode 54. This means that the contact area (electrolyzation area) between anode 54 and conductive film 56 is further increased.

Figure 11:
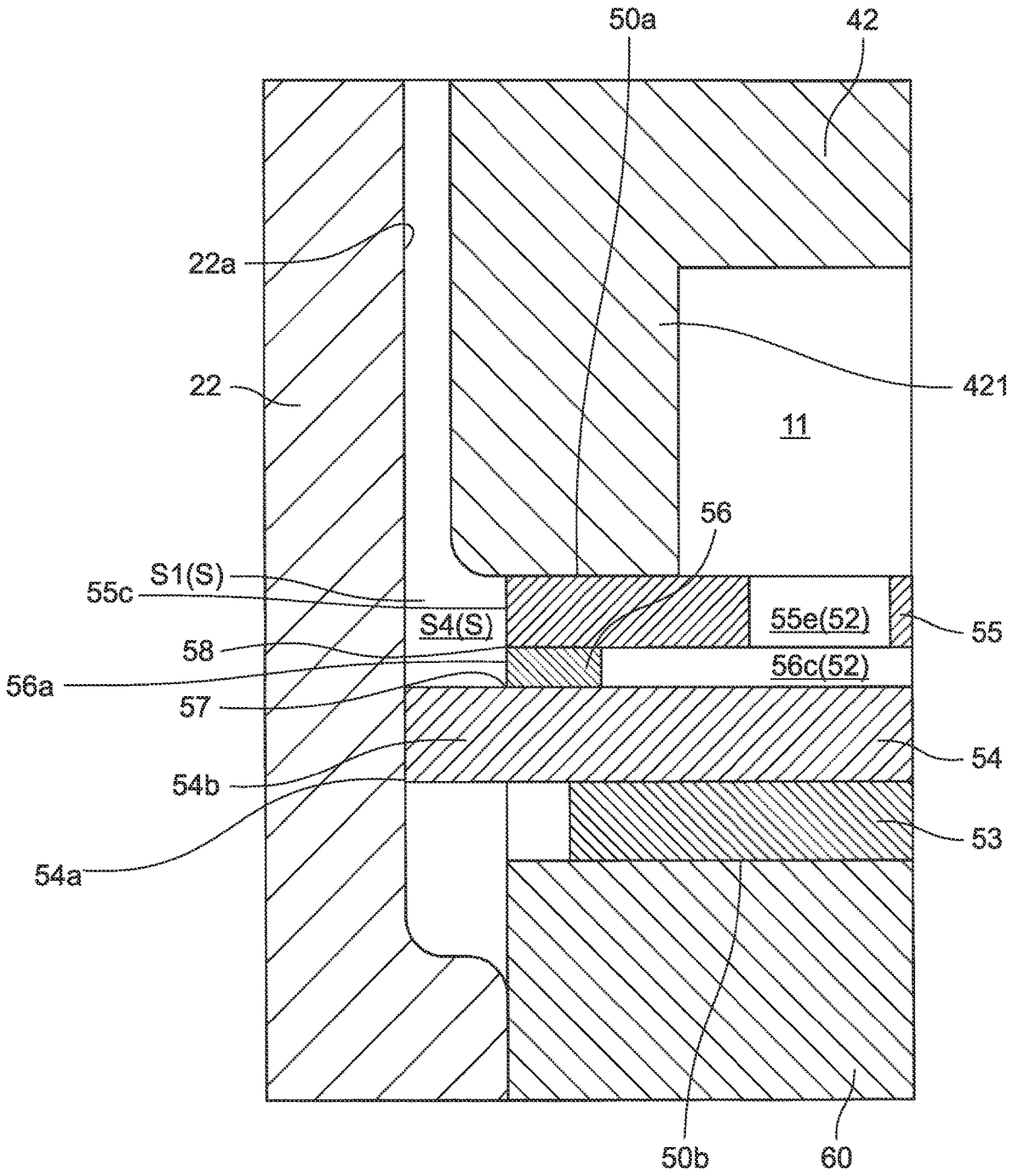
FIG. 11 is an enlarged view of a part of an electrolyzed water generator according to a fifth modification, showing a sectional view corresponding to the sectional view of FIG. 3.

FIG. 11 depicts stacked structure 51 in which anode-side protrusion 54*b*, which protrudes to be further outside than the outer periphery of cathode 55 and of conductive film 56, is formed on both sides in width direction Y of anode 54 in the same manner as in stacked structure 51 depicted in FIG. 10.

Outer periphery (side face extending along the lengthwise direction) 54*a* of anode 54 is in contact with inner surface 22*a* of peripheral wall 22, and space S is formed between outer periphery 55*c* of cathode 55, outer periphery 56*a* of conductive film 56 and inner surface 22*a* of peripheral wall 22. In other words, when stacked structure 51 is placed in recession 23, space S having cathode-side space (first space) S1 and upper-side space (fourth space) S4 is formed between outer periphery (side face) 51*a* of stacked structure 51 and inner surface 22*a* of peripheral wall 22.

This configuration also inhibits piling of scales between stacked structure 51 and peripheral wall 22.

In the configuration shown in FIG. 11 (configuration in which outer periphery 54*a* of anode 54 is brought into contact with inner surface 22*a* of peripheral wall 22), conductive film-side protrusion 56*d* shown in FIG. 7 can be formed on conductive film 56. Bring conductive film-side protrusion 56*d* into contact with inner surface 22*a* of peripheral wall 22, however, raises a concern that water may stay in the area between interface 58 and inner surface 22*a* of peripheral wall 22, where scales tend to develop. It is preferable for this reason that when conductive film-side protrusion 56*d* is formed, a gap with an adequate size for inhibiting water stagnation (space 5) be formed between outer periphery 56*a* of conductive film 56 and inner surface 22*a* of peripheral wall 22.

As described above, ozonized water generator (electrolytic solution generator) 1 according to the present exemplary embodiment includes electrolyzing unit 50 that has a stacked structure 51, in which conductive film 56 is interposed between anode 54 and cathode 55 (between the electrodes adjacent to each other), and that electrolyzes water (liquid). Ozonized water generator 1 includes also housing 10 housing electrolyzing unit 50 therein.

In housing 10, channel 11 is formed, channel 11 having inlet 111 into which water to be supplied to electrolyzing unit 50 flows and outlet 112 from which ozonized water (electrolyzed water, i.e., electrolytic solution) generated by electrolyzing unit 50 flows out and causing water to flow in liquid-flow direction X intersecting stacking direction Z of stacked structure 51.

In electrolyzing unit 50, grooves 52 are formed as grooves which are open to channel 11 and to which at least a part of interface 57 between conductive film 56 and one electrode (anode 54) and interface 58 between conductive film 56 and the other electrode (cathode 55) is exposed.

According to the present exemplary embodiment, the electrodes adjacent to each other are cathode 55 and anode 54, and space S that inhibits water stagnation is formed between the outer periphery of either cathode 55 or anode 54 and inner surface 22*a* of peripheral wall 22 (inner surface of the housing).

Space S may have cathode-side space (first space) 51 formed between outer periphery (side face) 55*c* of cathode 55 and inner surface 22*a* of peripheral wall 22 (inner surface of the housing).

Space S may have anode-side space (second space) S2 formed between outer periphery 54*a* of anode 54 and inner surface 22*a* of peripheral wall 22 (inner surface of the housing).

Space S may have lower-side space (third space) S3 formed in the area closer to anode 54 than to cathode 55 in stacking direction Z.

Forming such space S on the periphery of electrolyzing unit 50 inhibits water from staying on the periphery of electrolyzing unit 50. Inhibiting water from staying on the periphery of electrolyzing unit 50 inhibits sticking of scales to the periphery of electrolyzing unit 50 and to peripheral wall 22 (housing 10).

Even if scales stick to the periphery of electrolyzing unit 50 and to peripheral wall 22, space S formed between electrolyzing unit 50 and peripheral wall 22 suppresses pressure application by scales to electrolyzing unit 50 and peripheral wall 22, thereby suppresses deformation (warping or the like) of electrolyzing unit 50. Suppressing the deformation of electrolyzing unit 50 prevents a case where contact between anode 54 and conductive film 56 and between conductive film 56 and cathode 55 becomes irregular. In other words, anode 54 and conductive film 56 are brought into more uniform contact with each other and conductive film 56 and cathode 55 are also brought into more uniform contact with each other as well.

In this manner, forming space S between electrolyzing unit 50 and peripheral wall 22 suppresses the deformation of electrolyzing unit 50 caused by scales sticking thereto, thereby makes contact between the conductive film and electrodes of stacked structure 51 more uniform in electrolyzing unit 50. By making contact between the conductive film and electrodes of stacked structure 51 more uniform, a current-carrying area (e.g., electrolyzation area between conductive film 56 and cathode 55) can be secured more stably. Securing the current-carrying area more stably makes a density of current flow in electrolyzing unit 50 more uniform, thereby achieves more stable ozone (electrogenerated product) generation efficiency.

In this manner, according to the present exemplary embodiment, ozonized water generator 1 that can inhibit pressure application by scales to peripheral wall 22 (housing 10) and electrolyzing unit 50 can be obtained.

Outer periphery 55*c* of cathode 55 may be protruded to be further outside in width direction Y (direction intersecting stacking direction Z) than outer periphery 54*a* of anode 54.

This increases the area of cathode 55 by a protruded portion in width direction Y located further outside than outer periphery 54*a* of anode 54. As a result, the density of current flow in cathode 55 drops, which inhibits piling of scales, which are produced by electrolyzing, on the periphery of cathode 55.

Outer periphery 56*a* of conductive film 56 may be protruded to be further outside in width direction Y (direction intersecting stacking direction Z) than outer periphery 54*a* of anode 54.

In this structure, pressure application by scales to electrolyzing unit 50 and peripheral wall 22 is inhibited, and therefore more stable ozone (electrogenerated product) generation efficiency is achieved.

When cathode 55 and conductive film 56 are made larger in size in width direction Y than anode 54, conductive film 56 comes in contact also with the lower surfaces of both end sides in width direction Y of cathode 55. This allows more effective use of the increased area of cathode 55. This means that the contact area (electrolyzation area) between cathode 55 and conductive film 56 is further increased.

Space S may be formed at least on the periphery in the lengthwise direction of stacked structure 51.

This structure certainly inhibits water stagnation on the periphery of electrolyzing unit 50, thereby achieves more stable ozone (electrogenerated product) generation efficiency.

Positioning protrusions (housing protrusions) 221 protruding toward stacked structure 51 may be formed on the part of inner surface 22*a* of peripheral wall 22 (inner surface of the housing) that is counter to outer periphery 51*a* of stacked structure 51.

In this structure, when stacked structure 51 is just placed in recession 23, space S is formed between outer periphery (side face) 51*a* of stacked structure 51 and inner surface 22*a* of peripheral wall 22. A gap (space 5), therefore, can be provided certainly between stacked structure 51 and peripheral wall 22.

Cathode-side recessions 55*d* may be formed on the part of outer periphery 55*c* of cathode 55 that corresponds to the positioning protrusions (housing protrusions) 221.

This structure inhibits cathode 55 from interfering with positioning protrusions (housing protrusions) 221 when cathode 55 is disposed in recession 23. As a result, cathode 55 whose surface area is made large as much as possible can be disposed in recession 23.

Conductive film-side recessions 56*b* may be formed on the part of outer periphery 56*a* of conductive film 56 that corresponds to the positioning protrusions (housing protrusions) 221.

Because of this structure, when ozonized water is generated, conductive film 56 having swollen due to its absorption of water is inhibited from interfering with positioning protrusions (housing protrusions) 221. This means that a case where swelling conductive film 56 interferes with positioning protrusions (housing protrusions) 221 and deforms can be prevented. Hence contact between the conductive film and electrodes of stacked structure 51 is made more uniform, which allows achieving more stable ozone (electrogenerated product) generation efficiency.

The preferred exemplary embodiments of the present disclosure have been described above. However, the present disclosure is not limited to the above exemplary embodiments and can be modified into various forms of applications.

For example, the ozonized water generator that generates ozone and causes it to dissolve into water to generate ozonized water has been described in the above exemplary embodiment. A substance to be generated, however, is not limited to ozone. For example, hypochlorous acid may be generated to use it for sterilization, water processing, or the like. The electrolytic solution generator may also be an apparatus that generates oxygen water, hydrogen water, chlorine-containing water, or hydrogen peroxide water.

Such electrolytic solution generators may be incorporated in other apparatuses and equipment and used in such a state. When the electrolytic solution generator is incorporated in a different apparatus or equipment, the electrolytic solution generator should preferably be set in a standing position in which the inlet is located on the lower side while the outlet is located on the upper side, as ozonized water generator 1 is. Positioning of the electrolytic solution generator, however, is not limited to this. It may be set in other proper positions.

Anode 54 may be made of a material selected from, for example, conductive silicon, conductive diamond, titanium, platinum, lead oxide, and tantalum oxide, and may be made of any given material if anode 54 made of such a material serves as an electrode capable of generating electrolyzed water and having conductivity and durability. When anode 54 is a diamond electrode, a manufacturing method for anode 54 is not limited to a film deposition method. The substrate of anode 54 may be made of a non-metal material.

Cathode 55 is effective if it is an electrode combining conductivity and durability. It may be made of a material selected from, for example, platinum, titanium, stainless steel, and conductive silicon.

In the above exemplary embodiment, the ozonized water generator in which positioning protrusions (housing protrusions) 221 extending in stacking direction Z are formed on peripheral wall 22 has been described. The housing protrusions may be formed into various shapes. For example, housing protrusions extending in the lengthwise direction (liquid-flow direction X) may be formed on a part of peripheral wall 22 that correspond to outer periphery 54*a* of anode 54 (side faces of anode 54 that extend in the lengthwise direction). In this structure, space S can be secured certainly between stacked structure 51 and peripheral wall 22, and blocking of waterflow (liquid-flow) in space S by the housing protrusions can be inhibited.

Configurations of the housing and the electrolyzing unit and other detailed specifications (shapes, sizes, layout, and the like) may also be changed in a proper manner.

Second Exemplary Embodiment

A configuration of stacked structure 51 of ozonized water generator 1 according to the present disclosure will then be described in detail, as a second exemplary embodiment according to the present disclosure.

The same constituent elements as described in the first exemplary embodiment will be denoted by the same reference marks and will be omitted in further description. A basic configuration of ozonized water generator 1 according to the second exemplary embodiment is the same as that of ozonized water generator 1 according to the first exemplary embodiment.

According to the conventional technique described above, the holes formed on the cathode and the holes formed on the conductive film have the same shape. In other words, the holes on the cathode and the holes on the conductive film are formed such that their outline and size are the same in a plan view. The cathode and the conductive film are thus stacked in such a way as to superpose respective outlines of their holes one another to form the grooves.

However, according to the conventional technique, if the cathode is shifted relatively against the conductive film in a direction intersecting the stacking direction, it changes the electrolyzation area (contact area) between the cathode and the conductive film. This leads to a change in the density of current flow in the electrolyzing unit, thus resulting in a change in ozone generation efficiency.

By adopting a configuration that will be described below, an electrolytic solution generator that achieves more stable electrogenerated product generation efficiency can be obtained.

The following configuration example will be described on the assumption that anode 54 and conductive film 56 are configured to have substantially the same projection dimensions.

Figure 12:
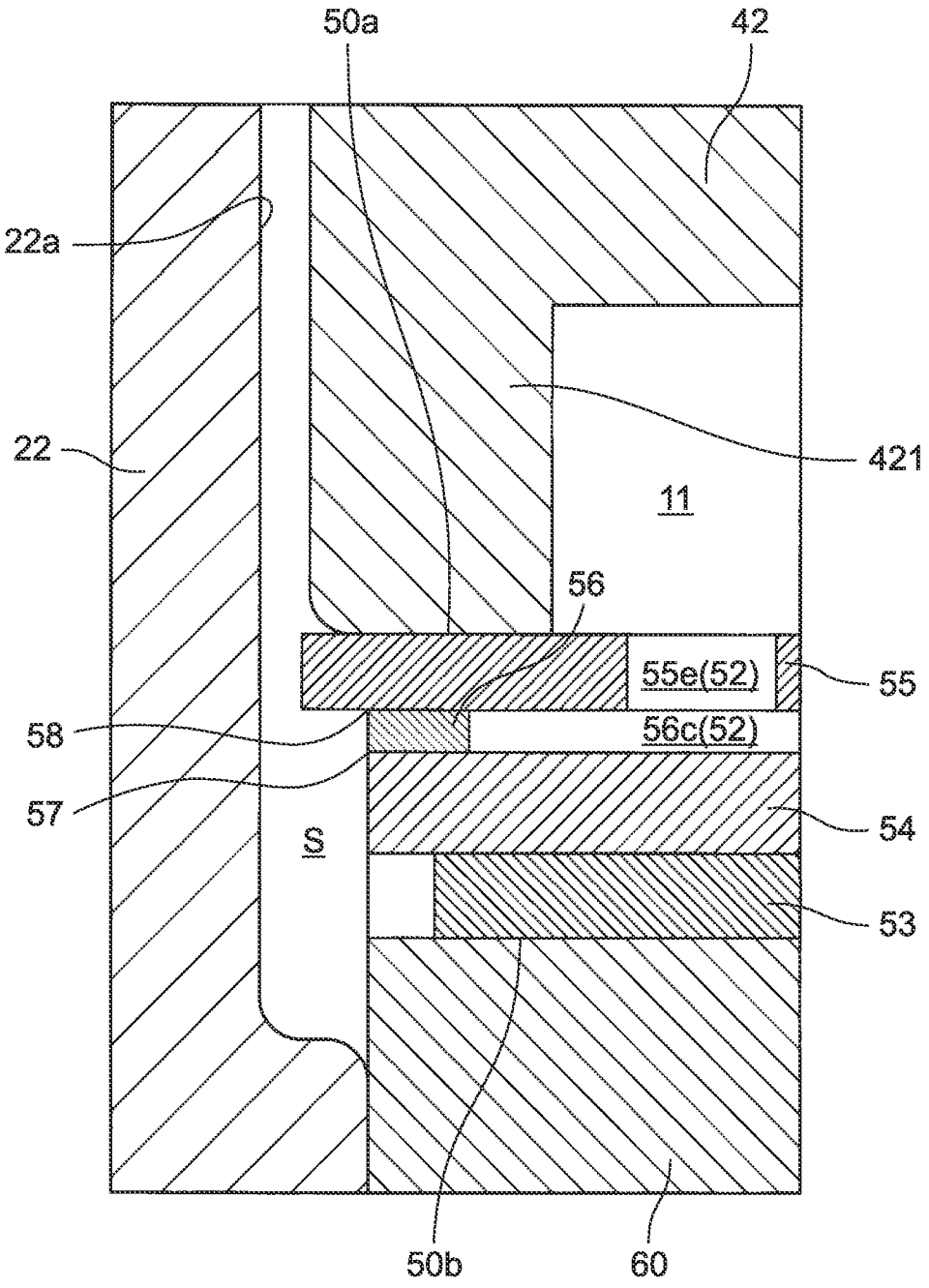
FIG. 12 is an enlarged view of a part of the electrolyzing unit according to the one exemplary embodiment of the present disclosure, the part having the conductive film-side groove formed therein.

When stacked structure 51 is formed, both ends in the width direction of cathode 55 protrude to be further outside than those of anode 54 and conductive film 56 (a configuration shown in FIG. 12).

If both ends in the width direction of cathode 55 are protruded to be further outside than those of anode 54 and conductive film 56, space S is formed at least between inner surface 22*a* of peripheral wall 22 and anode 54 when stacked structure 51 is placed in recession 23. This pace S is a space for inhibiting water stagnation between the periphery of stacked structure 51 and peripheral wall 22.

Forming such a space S inhibits scales made of a calcium component or the like, the scales being produced by water electrolyzation, from piling up between stacked structure 51 and peripheral wall 22.

According to the present exemplary embodiment, as shown in FIG. 12, space S is formed also between inner surface 22*a* of peripheral wall 22 and cathode 55.

The configuration of stacked structure 51 may be based on configurations shown in FIGS. 7 to 11. In other words, the basic configuration of the first exemplary embodiment and detailed configurations described in the second exemplary embodiment can be combined.

In the following configuration example, more stable generation efficiency of ozone 70 can be achieved.

Specifically, in a plan view (view along the stacking direction of stacked structure 51), conductive film-side hole 56*c* and cathode-side hole 55*e* are configured such that their shapes (outline and size) are different from each other.

Conductive film-side hole 56*c* is formed as an elongated hole long and narrow in width direction Y, while cathode-side hole 55*e* is formed as a V-shaped hole with its bent portion 55*f* located on the downstream side in a plan view. In this manner, conductive film-side hole 56*c* and cathode-side hole 55*e* are made different in outline from each other in a plan view (see FIGS. 4 and 13).

Figure 13:
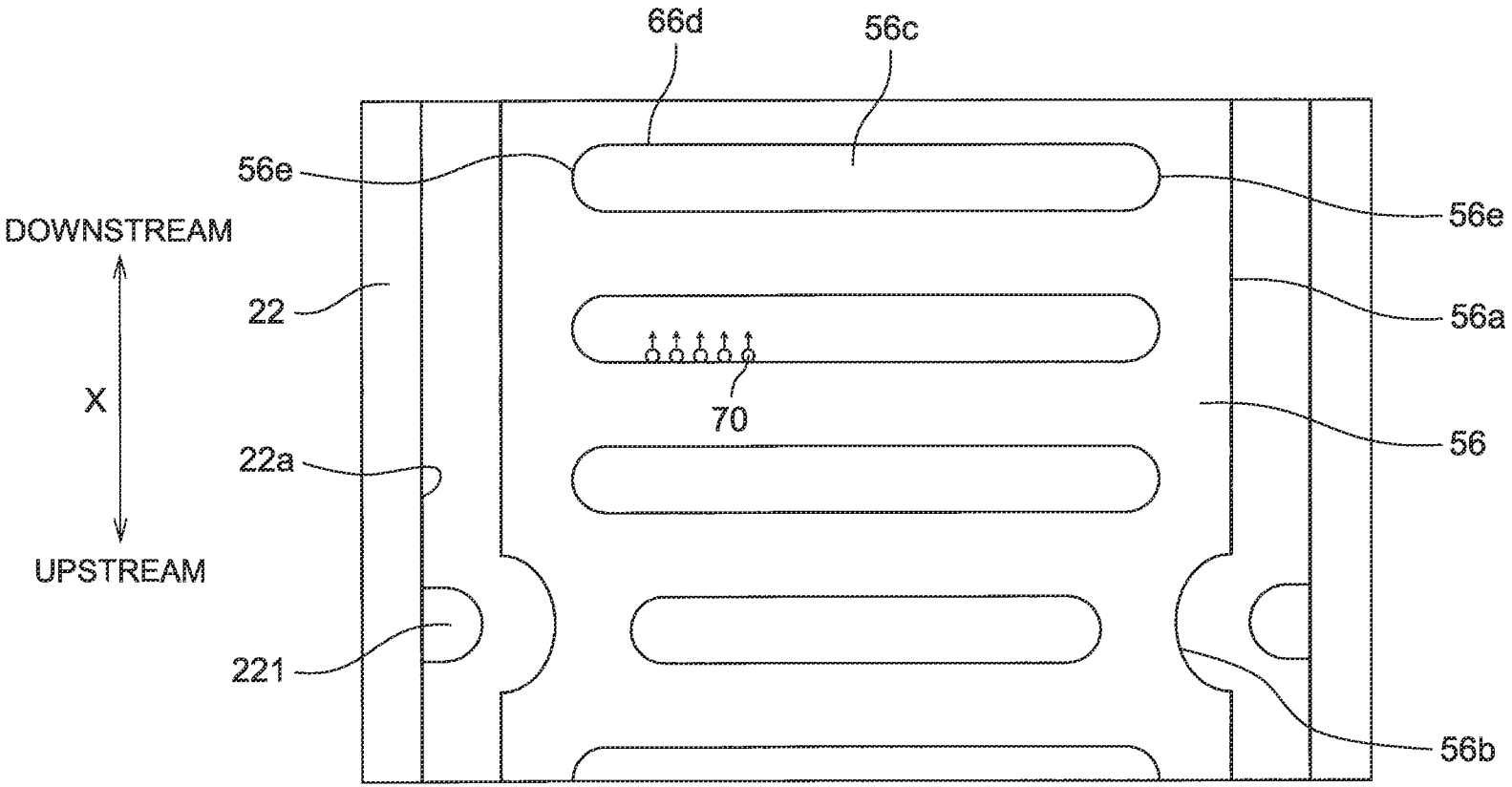
FIG. 13 is an enlarged plan view of a part of the conductive film stacked on the anode, according to the one exemplary embodiment of the present disclosure.

In this manner, conductive film-side hole 56*c* formed as an elongated hole long and narrow in width direction Y extends in the direction (width direction Y) perpendicular to liquid-flow direction X in a plan view (see FIG. 13). This means that, in a plan view, an angle that the direction of extension of conductive film-side hole 56*c* makes with liquid-flow direction X is 90 degrees.

Cathode-side hole 55*e*, on the other hand, has a shape such that two elongated holes, which extend from the outer side in width direction Y on the upstream side toward bent portion 55*f* located at a canter in width direction Y on the downstream side, join at bent portion 55*f* to communicate with each other. In other words, two elongated holes, which extend from bent portion 55*f* toward front ends 55*h*, extend in a direction intersecting liquid-flow direction X in a plan view (see FIG. 14).

Cathode-side hole 55*e* is formed such that front ends 55*h* are located on the outer side in width direction Y on the upstream side to bent portion 55*f*. Being configured in this manner, two elongated holes making up cathode-side hole 55*e* each extend in a direction intersecting liquid-flow direction X and width direction Y (direction perpendicular to liquid-flow direction X) as well. The direction of extension of each of two elongated holes making up cathode-side hole 55*e* makes an acute angle with liquid-flow direction X, and an absolute value of the acute angle is larger than 0 degree and smaller than 90 degrees.

Cathode-side hole 55*e*, therefore, can be formed as, for example, a V-shaped groove having one elongated hole extending in a direction tilted against liquid-flow direction X at 30 degrees and the other elongated hole extending in a direction tilted against liquid-flow direction X at −30 degrees.

It is unnecessary to match the absolute value of the acute angle that the direction of extension of one elongated hole makes with liquid-flow direction X to the absolute value of the acute angle that the direction of extension of the other elongated hole makes with liquid-flow direction X. In other words, it is unnecessary to make the shape of cathode-side hole 55*e* in a plan view axisymmetry with respect to a straight line passing through bent portion 55*f* and extending in liquid-flow direction X.

According to the present exemplary embodiment, in a state in which cathode 55 is stacked on conductive film 56, respective directions of extension of two elongated holes making up cathode-side hole 55*e* are not parallel with the direction of extension of conductive film-side hole 56*c*.

Conductive film-side hole 56*c* and cathode-side hole 55*e* are configured such that when cathode 55 is stacked on conductive film 56, conductive film-side hole 56*c* and cathode-side hole 55*e* partially communicate with each other. In other words, conductive film-side hole 56*c* and cathode-side hole 55*e* are configured such that part of a plurality of elongated holes extending in different directions communicate with each other.

Figure 14:
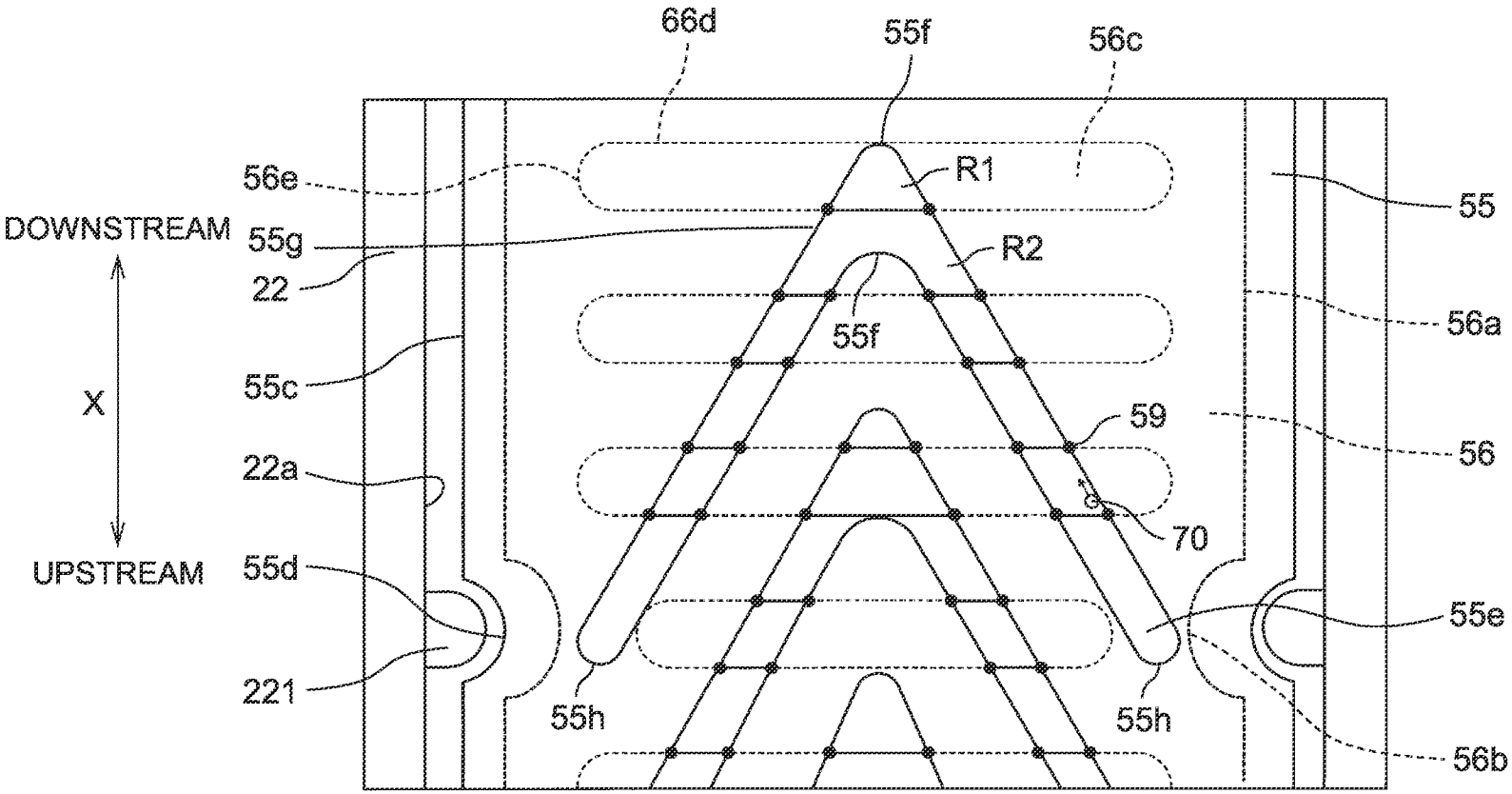
FIG. 14 is an enlarged plan view of a part of the cathode stacked on the conductive film, according to the one exemplary embodiment of the present disclosure.

In this configuration, conductive film 56 and cathode 55 are stacked such that, in a plan view, they have intersecting portions 59 at which outer periphery (outline in a plan view) 66*d* of conductive film-side hole 56*c* intersects outer periphery (outline in a plan view) 55*g* of cathode-side hole 55*e* (see FIG. 14).

On conductive film 56, conductive film-side holes 56*c* are formed such that they are lined up along liquid-flow direction X. On cathode 55, cathode-side holes 55*e* are formed such that they are lined up along liquid-flow direction X.

Two cathode-side holes 55*e* adjacent to each other in liquid-flow direction X are arranged such that bent portion 55*f* of one cathode-side hole 55*e* on the upstream side is located downstream to front ends 55*h* of another cathode-side hole 55*e* on the downstream side. Conductive film-side holes 56*c* and cathode-side holes 55*e* are arranged such that when cathode 55 is stacked on conductive film 56, a plurality of conductive film-side holes 56*c* intersect one cathode-side hole 55*e*.

Thus, in a plan view of the state in which cathode 55 is stacked on conductive film 56, a plurality of communication regions R1, where cathode-side holes 55*e* communicate with conductive film-side holes 56*c*, and a plurality of exposed regions R2, where conductive film 56 is exposed, are formed in one cathode-side holes 55*e*. In other words, a plurality of intersecting portions 59 are formed in one cathode-side holes 55*e*.

It is preferable that conductive film-side holes 56*c* each have the same shape and cathode-side holes 55*e* each have the same shape as well and that the pitch of conductive film-side holes 56*c* in liquid-flow direction X be equal to that of cathode-side holes 55*e* in liquid-flow direction X.

In this configuration, communication regions R1 and exposed regions R2 appear in a regular pattern along liquid-flow direction X.

In this example, cathode 55 is larger in width in width direction Y than conductive film 56. The contact area (electrolyzation area) between cathode 55 and conductive film 56 is, therefore, can be approximated by deducting a total area of exposed regions R2 from an area of an upper surface of conductive film 56, that is, an area of a part of the upper surface of conductive film 56 where conductive film-side holes 56*c* are not formed.

Cathode 55 and conductive film 56 are configured in the above manner, in which case, even if conductive film 56 is shifted in position relatively against cathode 55 upon formation of stacked structure 51, an amount of change in the contact area (electrolyzation area) between cathode 55 and conductive film 56 can be kept small. When such a positional shift occurs in the configuration described in the present exemplary embodiment and in the configuration achieved by the conventional technique, if an extent of the positional shift is the same in both configurations, the configuration described in the present exemplary embodiment keeps the amount of change in the electrolyzation area smaller than that in the configuration achieved by the above technique.

Figure 15:
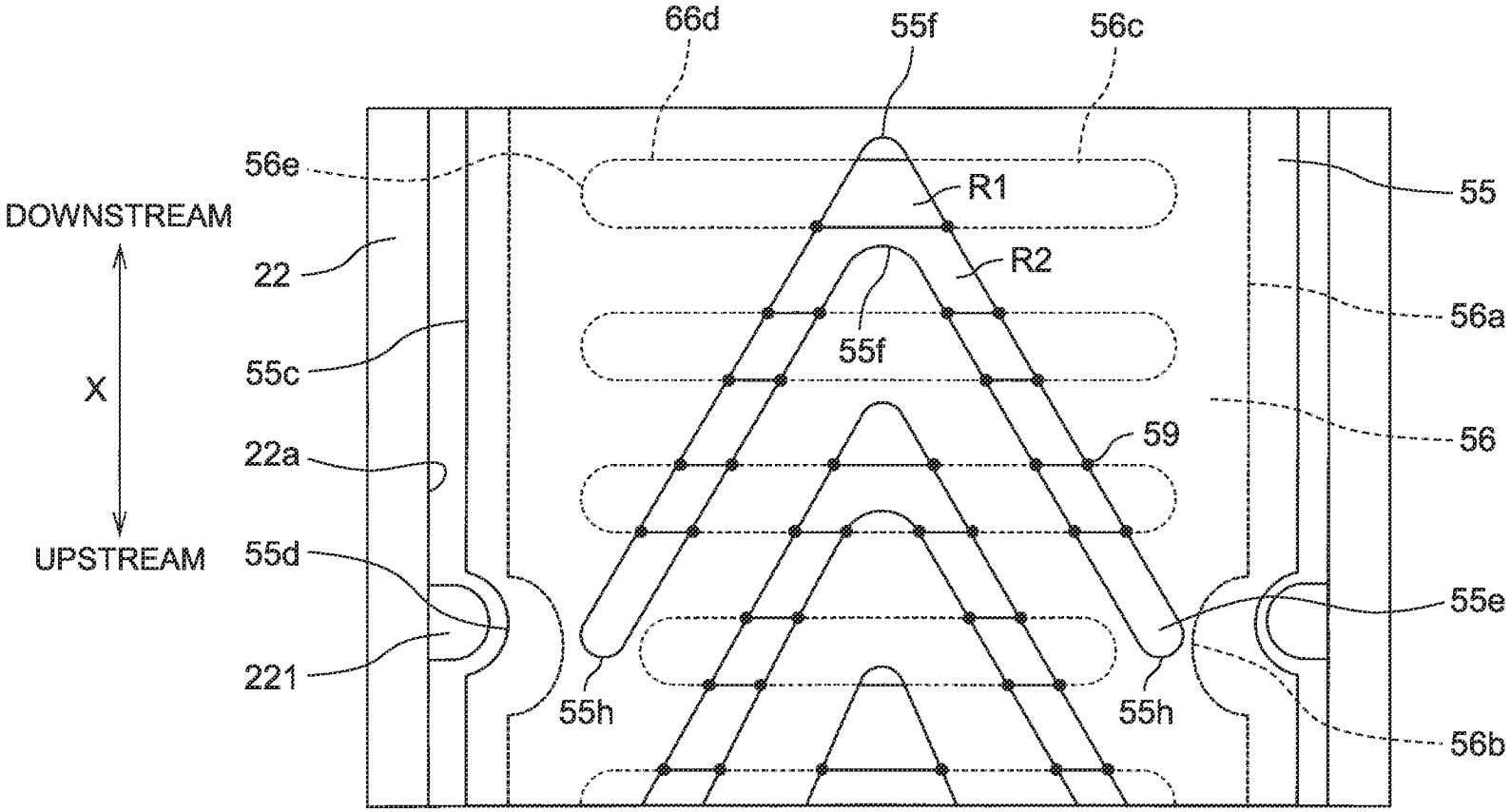
FIG. 15 depicts the conductive film shifted in position relatively against the cathode in a liquid-flow direction, according to the one exemplary embodiment of the present disclosure, showing a plan view corresponding to the plan view of FIG. 14.

For example, as shown in FIG. 15, when conductive film 56 is shifted in position relatively against cathode 55 in liquid-flow direction X upon formation of stacked structure 51, an area of one exposed region R2 (and an area of one communication region R1) changes slightly near bent portion 55*f* of cathode-side hole 55*e*. The area of one exposed region R2, however, changes little on other parts of cathode-side hole 55*e*. Thus, an amount of change in the total area of exposed regions R2 of one cathode-side hole 55*e* is almost equal to an amount of change in the area of one exposed region R2 near bent portion 55*f*.

In this example, even if conductive film 56 is shifted relatively against cathode 55 in liquid-flow direction X, outer periphery (outline in a plan view) 56*a* of conductive film 56 comes in contact with cathode 55 when an extent of the positional shift is moderate. This prevents a case where the contact area between conductive film 56 and cathode 55 changes as a result of outer periphery (outline in a plan view) 56*a* of conductive film 56 shifting to stick out of cathode 55.

In such a configuration, following the positional shift in liquid-flow direction X, the contact area between conductive film 56 and cathode 55 changes slightly from the contact area between conductive film 56 and cathode 55 in the case of conductive film 56 being stacked in its specified position.

Figure 16:
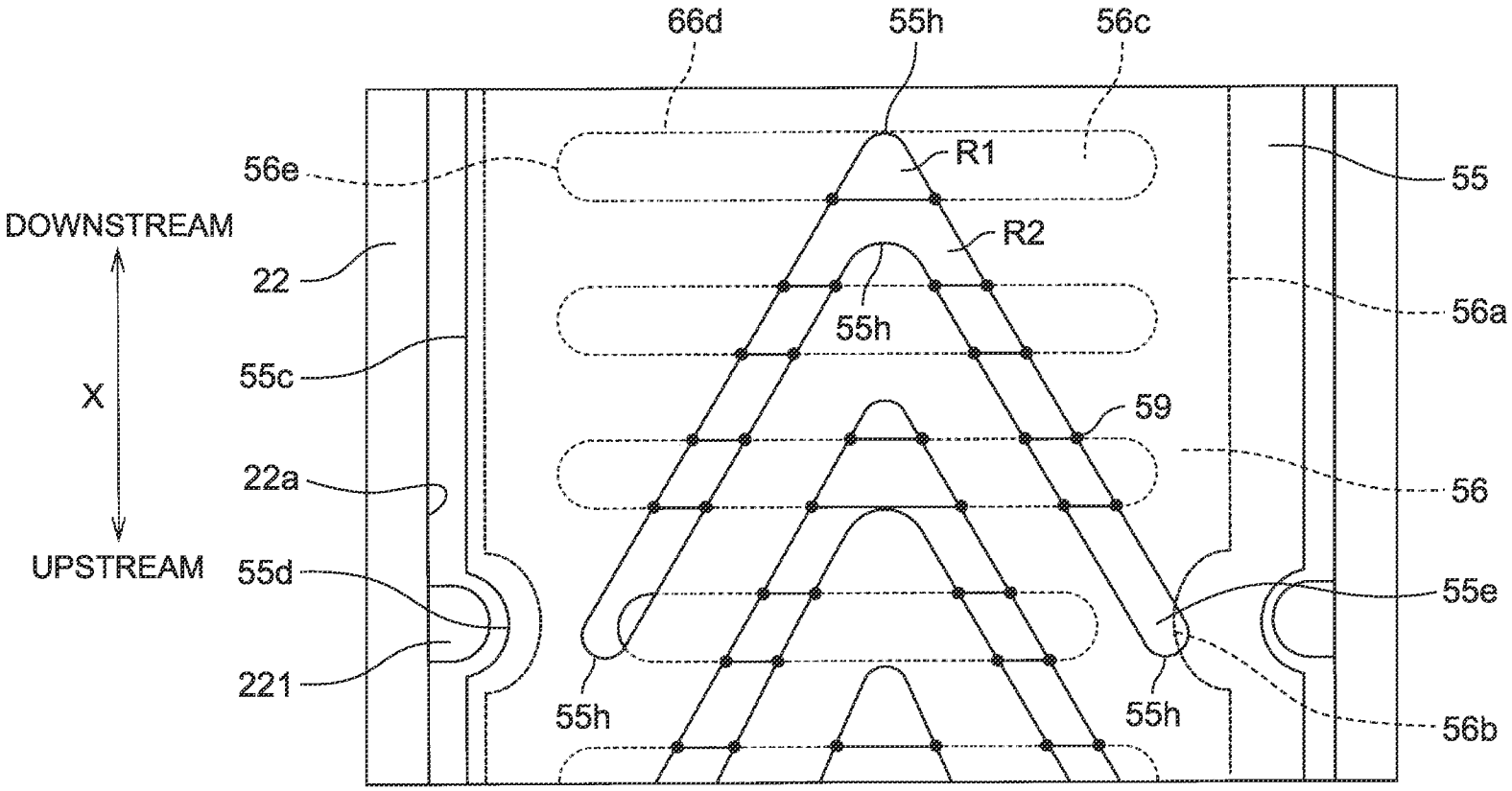
FIG. 16 depicts the conductive film shifted in position relatively against the cathode in a width direction, according to the one exemplary embodiment of the present disclosure, showing a plan view corresponding to the plan view of FIG. 14.

As shown in FIG. 16, when conductive film 56 is shifted in position relatively against cathode 55 in width direction Y upon formation of stacked structure 51, the area of one exposed region R2 (and the area of one communication region R1), basically, changes little. However, on a part where conductive film-side recessions 56*b* serving as the relief portions are formed, conductive film-side hole 56*c* is slightly shorter in width direction Y. On this part, therefore, the area of one exposed region R2 changes slightly.

In this manner, in the case of a relative positional change in width direction Y, an amount of change in a total area of exposed regions R2 of one cathode-side hole 55*e* is almost equal to an amount of change in the area of one exposed region R2 on the part where conductive film-side recessions 56*b* serving as the relief portions are formed.

As shown in FIG. 16, even if conductive film 56 is shifted relatively against cathode 55 in width direction Y, outer periphery (outline in a plan view) 56*a* of conductive film 56 comes in contact with cathode 55 when an extent of the positional shift is moderate. In such a configuration, therefore, following the positional shift in width direction Y, the contact area between conductive film 56 and cathode 55 changes slightly from the contact area between conductive film 56 and cathode 55 in the case of conductive film 56 being stacked in its specified position.

Thus, in this configuration, a relative shift of conductive film 56 against cathode 55 in a direction along a horizontal plane (liquid-flow direction X and width direction Y) merely results in a slight shift of the contact area between conductive film 56 and cathode 55.

In contrast, when the holes of the same shape are superposed one another to form the grooves, as in the case of the above conventional technique, a positional shift of conductive film 56 against cathode 55 leads to formation of exposed regions R2, which are not formed in a normal state without a positional shift, in the grooves.

In this case, therefore, a total area of exposed regions R2 formed respectively in the grooves is equivalent to an amount of change in the contact area between conductive film 56 and cathode 55. Exposed regions R2 newly formed respectively in the grooves create an amount of change in the contact area between conductive film 56 and cathode 55 that is greater than an amount of change in the contact area between conductive film 56 and cathode 55 that would result in the configuration according to the present exemplary embodiment when the same extent of a positional shift occurs.

For example, when conductive film 56 is shifted against cathode 55 in liquid-flow direction X, it merely lead to a change in the area of exposed region R2 near bent portion 55*f* in the configuration according to the present exemplary embodiment. In the configuration according to the conventional technique, however, this positional shift, if it is the same in extent as the positional shift in the configuration according to the present exemplary embodiment, leads to formation of exposed region R2 which projects in liquid-flow direction X by the extent of the positional shift and extends along almost the whole of groove 52 in its width direction Y. In this manner, when conductive film 56 is shifted against cathode 55, if an extent of the positional shift is the same in both configurations, the amount of change in the contact area between conductive film 56 and cathode 55 becomes smaller in the configuration according to the present exemplary embodiment than in the configuration according to the above technique.

According to the present exemplary embodiment, curved portions 56*e*, which are arcuate in a plan view, are formed respectively on both ends in width direction Y of conductive film-side hole 56*c*. As a result, no sharp edge is formed on outer periphery (outline in a plan view) 66*d* of conductive film-side hole 56*c*.

Likewise, curved portions, which are arcuate in a plan view, are formed respectively on bent portion 55*f* and front ends 55*h* of cathode-side hole 55*e*. As a result, no sharp edge is formed on outer periphery (outline in a plan view) 55*g* of cathode-side hole 55*e*.

In this manner, outer periphery (outline in a plan view) 66*d* of conductive film-side hole 56*c* and outer periphery (outline in a plan view) 55*g* of cathode-side hole 55*e* are made into smooth shapes. This alleviates local concentration of an electric filed during an electrolyzing process. As a result, ozone 70 can be generated more uniformly across a part of interface 57 that is exposed to grooves 52 (see FIG. 13). Hence more stable generation efficiency of ozone 70 can be achieved.

According to the present exemplary embodiment, groove 52 has conductive film-side hole (conductive film-side groove) 56*c* formed on conductive film 56 and cathode-side hole (electrode-side groove) 55*e* formed on cathode (electrode) 55 and communicating with conductive film-side hole 56*c*.

In a view along stacking direction Z of stacked structure 51, conductive film-side hole 56*c* and cathode-side hole 55*e* are different in shape from each other.

In this structure, even if conductive film 56 is shifted against cathode (electrode) 55 relatively in a direction intersecting stacking direction Z, a change in the contact area between conductive film 56 and cathode (electrode) 55 can be suppressed. This means that the electrolyzation area (current-carrying area) between conductive film 56 and cathode (electrode) 55 can be secured more stably.

Securing the electrolyzation area (current-carrying area) between conductive film 56 and cathode (electrode) 55 stably in this manner makes the density of current flow in electrolyzing unit 50 more uniform. For each product, therefore, a change in the density of current flow in electrolyzing unit 50 can be suppressed. As a result, more stable generation efficiency of ozone (electrogenerated product) 70 is achieved.

In this manner, according to the present exemplary embodiment, even if conductive film 56 and cathode (electrode) 55 are shifted in position against each other, more stable generation efficiency of ozone (electrogenerated product) 70 is achieved. In other words, ozonized water generator 1 with substantially constant generation efficiency of ozone (electrogenerated product) 70 can be obtained.

According to the present exemplary embodiment, conductive film 56 and cathode 55 are stacked such that, in a plan view along stacking direction Z of stacked structure 51, they have intersecting portions 59 at which outer periphery (outline in a plan view) 66*d* of conductive film-side hole 56*c* intersects outer periphery (outline in a plan view) 55*g* of cathode-side hole 55*e*. In this structure, when conductive film 56 and cathode (electrode) 55 are shifted relatively against each other, a change in the contact area between conductive film 56 and cathode (electrode) 55 can be suppressed more certainly.

According to the present exemplary embodiment, conductive film-side hole 56*c* extends in the direction intersecting liquid-flow direction X (in which a liquid flows).

In this structure, ozone 70 generated near interface 57 between conductive film 56 and anode 54 can be separated quickly from interface 57. In other words, bubbles of ozone 70 generated near interface 57 is inhibited from growing bigger.

If ozone 70 grows into large bubbles of ozone, such bubbles of ozone, even if they are separated from interface 57, may not dissolve into water (liquid) and keep floating therein. This may lead to a drop in a concentration of ozone (electrogenerated product) 70 dissolved in water (liquid).

However, if conductive film-side holes 56*c* are formed in such a way as to extend in the direction intersecting liquid-flow direction X, as described in the present exemplary embodiment, ozone 70 can be separated from interface 57 before it grows into large bubbles of ozone. This enhances the process of ozone (electrogenerated product) 70 dissolving into water (liquid).

According to the present exemplary embodiment, conductive film-side holes 56*c* extend in the direction intersecting liquid-flow direction X.

In this structure, ozone 70 generated near interface 57 between conductive film 56 and anode 54 can be separated quickly from interface 57.

According to the present exemplary embodiment, the electrodes adjacent to each other are cathode 55 and anode 54. The electrode-side grooves have cathode-side holes (cathode-side grooves) 55*e*, which are formed in cathode 55 and extend in the direction intersecting liquid-flow direction X.

In this structure, stagnation of ozone (electrogenerated product) 70 in grooves 52 is inhibited to cause ozone 70 to flow through channel 11 more efficiently.

According to the present exemplary embodiment, cathode-side hole 55*e* is of the V shape with its bent portion 55*f* located on the downstream side in a view along stacking direction Z of stacked structure 51.

In this structure, generated ozone (electrogenerated product) 70 migrates toward the central part of cathode-side hole 55*e*, where the flow velocity is relatively high, along a slope of cathode-side hole 55*e*. This process further inhibits the stagnation of ozone (electrogenerated product) 70. As a result, ozone concentration (electrogenerated product concentration) is further enhanced.

It is preferable that conductive film-side holes 56*c* each have the same shape and cathode-side holes 55*e* each have the same shape as well and that the pitch of conductive film-side holes 56*c* in liquid-flow direction X be equal to that of cathode-side holes 55*e* in liquid-flow direction X.

This arrangement causes communication regions R1 and exposed regions R2 to appear in a regular pattern in liquid-flow direction X, thus reducing the effect of a positional shift more certainly.

It is preferable that curved portions 56*e*, which are arcuate in a plan view, be formed respectively on both ends in width direction Y of conductive film-side hole 56*c*.

Likewise, it is preferable that curved portions, which are arcuate in a plan view, be formed respectively on bent portion 55*f* and front ends of cathode-side hole 55*e*.

This alleviates local concentration of an electric filed during the electrolyzing process. As a result, ozone 70 can be generated more uniformly across the part of interface 57 that is exposed to grooves 52. Hence more stable generation efficiency of ozone 70 can be achieved.

Cathode-side holes 55*e* may be each formed into an elongated shape extending in liquid-flow direction X and be arranged such that when cathode 55 and conductive film 56 are stacked, cathode-side holes 55*e* and conductive film-side holes 56*c* cross each other crosswise in a plan view.

The direction of extension of conductive film-side holes 56*c* may be determined to be a direction intersecting both liquid-flow direction X and width direction Y (perpendicular to liquid-flow direction X). It is preferable in such a case that the direction of extension of conductive film-side holes 56*c* be not parallel with the direction of extension of cathode-side holes 55*e* so that conductive film-side holes 56*c* intersect cathode-side holes 55*e* when conductive film 56 and cathode 55 are stacked.

Conductive film-side holes 56*c* and cathode-side holes 55*e* may have shapes similar to each other so that smaller shapes are present in larger shapes when conductive film 56 and cathode 55 are stacked.

Conductive film-side hole 56*c* and cathode-side hole 55*e* may have a V shape and an elongated shape, respectively.

Configurations of the electrode case and electrode case lid and other detailed specifications (shapes, sizes, layout, and the like) may also be changed in a proper manner.

As described above, the present disclosure may be embodied in the following mode.

An electrolytic solution generator includes an electrolyzing unit having a stacked structure in which a conductive film is interpose between a plurality of electrodes adjacent to each other, the electrolyzing unit electrolyzing a liquid, and a housing in which the electrolyzing unit is placed.

In the housing, a channel is formed, the channel having an inlet into which a liquid to be supplied to the electrolyzing unit flows and an outlet from which an electrolytic solution generated by the electrolyzing unit flows out and causing a liquid to flow in a liquid-flow direction intersecting a stacking direction of the stacked structure.

In electrolyzing unit, grooves are formed as grooves which are open to the channel and to which at least a part of interfaces between the conductive film and the electrodes is exposed.

Each of the grooves has a conductive film-side groove formed on the conductive film and an electrode-side groove formed on the electrodes and communicating with the conductive-side groove.

In a view along the stacking direction of the stacked structure, the conductive film-side groove and the electrode-side groove are different in shape from each other.

The conductive film and the electrodes may be stacked such that, in a plan view along the stacking direction of the stacked structure, the conductive film and the electrodes have intersecting portions at each of which an outer periphery of the conductive film-side groove intersects an outer periphery of the electrode-side groove.

The conductive film-side groove may extend in a direction intersecting the liquid-flow direction.

The conductive film-side groove may extend in a direction perpendicular to the liquid-flow direction.

The electrodes adjacent to each other may be a cathode and an anode, the electrode-side groove may have a cathode-side groove formed on the cathode, and the cathode-side groove may extend in a direction intersecting the liquid-flow direction.

The cathode-side groove may be of a V shape with a bent portion located on the downstream side in a view along the stacking direction of the stacked structure.

The preferred exemplary embodiments of the present disclosure have been described above. However, the present disclosure is not limited to the above exemplary embodiments and can be modified into various forms of applications.

For example, the ozonized water generator that generates ozone and causes it to dissolve into water to generate ozonized water has been described in the above exemplary example. A substance to be generated, however, is not limited to ozone. For example, hypochlorous acid may be generated to use it for sterilization, water processing, or the like. The ozonized water generator may also work as an apparatus that generates oxygen water, hydrogen water, chlorine-containing water, or hydrogen peroxide water.

Such electrolytic solution generators may be incorporated in other apparatuses and equipment and used in such a state. When the electrolytic solution generator is incorporated in a different apparatus or equipment, the electrolytic solution generator should preferably be set in a standing position in which the inlet is located on the lower side while the outlet is located on the upper side, as ozonized water generator 1 is. Positioning of the electrolytic solution generator, however, is not limited to this. It may be set in other proper positions.

Anode 54 may be made of a material selected from, for example, conductive silicon, conductive diamond, titanium, platinum, lead oxide, and tantalum oxide. Anode 54 may be made of any given material if such a material makes up an electrode having enough conductivity and durability for generating electrolyzed water. When anode 54 is a diamond electrode, a manufacturing method for anode 54 is not limited to a film deposition method. The substrate of anode 54 may be made of a non-metal material.

Cathode 55 is effective if it is an electrode combining conductivity and durability. It may be made of a material selected from, for example, platinum, titanium, stainless steel, and conductive silicon.

Cathode-side holes 55*e* may be each formed into an elongated shape extending in liquid-flow direction X and be arranged such that when cathode 55 and conductive film 56 are stacked, cathode-side holes 55*e* and conductive film-side holes 56*c* cross each other crosswise in a plan view.

The direction of extension of conductive film-side holes 56*c* may be determined to be a direction intersecting both liquid-flow direction X and width direction Y (perpendicular to liquid-flow direction X). It is preferable in such a case that the direction of extension of conductive film-side holes 56*c* be not parallel with the direction of extension of cathode-side holes 55*e* so that conductive film-side holes 56*c* intersect cathode-side holes 55*e* when conductive film 56 and cathode 55 are stacked.

Conductive film-side holes 56*c* and cathode-side holes 55*e* may have shapes similar to each other so that smaller shapes are present in larger shapes when conductive film 56 and cathode 55 are stacked.

Conductive film-side hole 56*c* and cathode-side hole 55*e* may have a V shape and an elongated shape, respectively.

Configurations of the electrode case and electrode case lid and other detailed specifications (shapes, sizes, layout, and the like) may also be changed in a proper manner.

As described above, according to the present disclosure, the electrolytic solution generator offers a special effect of inhibiting pressure application by scales to the housing and the electrolyzing unit. The present disclosure can be applied to electrical equipment that uses an electrolytic solution generated by the electrolytic solution generator and to liquid reformer or the like equipped with the electrolytic solution generator, and is useful in such applications.

What is claimed is:

1. An electrolytic solution generator comprising:

an electrolyzing unit having a stacked structure in which a conductive film is interposed between a cathode and an anode, the electrolyzing unit electrolyzing a liquid; and a housing in which the electrolyzing unit is disposed, the housing includes a channel, the channel having an inlet into which a liquid to be supplied to the electrolyzing unit flows and an outlet from which an electrolytic solution generated by the electrolyzing unit flows out, the channel causing a liquid to flow in a liquid-flow direction intersecting a stacking direction of the stacked structure, the electrolyzing unit includes a groove, the groove being open to the channel, at least a part of an interface between the conductive film and the cathode and an interface between the conductive film and the anode being exposed to the groove, the groove has a conductive film-side groove disposed on the conductive film, and an electrode-side groove disposed on at least either the cathode or the anode and communicating with the conductive film-side groove, and in a view along the stacking direction of the stacked structure, the conductive film-side groove is different in shape from the electrode-side groove.

2. The electrolytic solution generator according to claim 1, wherein the conductive film is stacked together with either the cathode or the anode in an arrangement in which, in a view along the stacking direction of the stacked structure, the conductive film and the cathode or the anode have an intersecting portion at which an outer periphery of the conductive film-side groove intersects an outer periphery of the electrode-side groove.

3. The electrolytic solution generator according to claim 1, wherein the conductive film-side groove extends in a direction intersecting the liquid-flow direction.

4. The electrolytic solution generator according to claim 3, wherein the conductive film-side groove extends in a direction perpendicular to the liquid-flow direction.

5. The electrolytic solution generator according to claim 1, wherein the electrode-side groove has a cathode-side groove disposed on the cathode, and the cathode-side groove extends in a direction intersecting the liquid-flow direction.

6. The electrolytic solution generator according to claim 5, wherein the cathode-side groove is of a V shape with a bent portion located on a downstream side in a view along the stacking direction of the stacked structure.

* * * * *